US007591611B2

(12) United States Patent
Arellanes et al.

(10) Patent No.: US 7,591,611 B2
(45) Date of Patent: Sep. 22, 2009

(54) FLUENT MATERIAL CONFINEMENT SYSTEM

(75) Inventors: Alvin M. Arellanes, Mountain View, CA (US); Barney Greinke, Berkeley, CA (US); John Sikora, San Francisco, CA (US); Aaron Arellanes, Petaluma, CA (US)

(73) Assignee: Geocell Systems, Inc., San Francisco, CA (US)

( * ) Notice: Subject to any disclaimer, the term of this patent is extended or adjusted under 35 U.S.C. 154(b) by 0 days.

(21) Appl. No.: 11/717,433

(22) Filed: Mar. 12, 2007

(65) Prior Publication Data

US 2008/0038064 A1 Feb. 14, 2008

Related U.S. Application Data

(60) Continuation of application No. 11/187,342, filed on Jul. 21, 2005, now abandoned, which is a continuation-in-part of application No. PCT/US2004/043046, filed on Dec. 20, 2004, which is a continuation-in-part of application No. 10/984,266, filed on Nov. 8, 2004, which is a division of application No. 10/633,297, filed on Jul. 31, 2003, now Pat. No. 6,817,806, which is a continuation of application No. 10/086,772, filed on Feb. 28, 2002, now abandoned.

(60) Provisional application No. 60/272,128, filed on Feb. 28, 2001, provisional application No. 60/274,738, filed on Mar. 9, 2001.

(51) Int. Cl.
*E02B 7/02* (2006.01)
*E04C 2/42* (2006.01)

(52) U.S. Cl. ..... 405/114; 405/111; 405/116; 52/668; 428/12

(58) Field of Classification Search ..... None
See application file for complete search history.

(56) References Cited

U.S. PATENT DOCUMENTS 1,006,716 A 10/1911 Bloomer (Continued)

FOREIGN PATENT DOCUMENTS

DE 127104 11/1900

(Continued)

OTHER PUBLICATIONS

Webster et al., "Investigation of Construction Concepts for Pavements Across Soft Ground", Technical Report S-78-6, Geotechnical Laboratory, U.S. Army Engineer Waterways Experiment Station, Vicksburg, Mississippi, Jul. 1978, 82 pages.

(Continued)

*Primary Examiner*—Tara Mayo-Pinnock
(74) *Attorney, Agent, or Firm*—Alleman Hall McCoy Russell & Tuttle LLP

(57) ABSTRACT

A fluent material confinement system configured to receive a granular fluent material to form a temporary barrier structure is disclosed, wherein the fluent material confinement system includes a plurality strips, the plurality of strips including a plurality of lengthwise strips and a plurality of widthwise strips coupled with each other to define a plurality of open cells, wherein the plurality of lengthwise strips includes at least one wider lengthwise strip configured to extend into cells of a next-lowest fluent material confinement system when the fluent material confinement system is stacked on the next-lowest fluent material confinement system, and a stacking error indicator associated with the wider lengthwise strip, wherein the stacking error indicator is configured to be effective in low visibility conditions to indicate to a user a location of an error in stacking of the fluent material confinement system on the next-lowest fluent material confinement system.

20 Claims, 13 Drawing Sheets

U.S. PATENT DOCUMENTS

| | | | | | |
|---|---|---|---|---|---|
| 1,081,476 | A | | 12/1913 | Wellen | |
| 1,896,957 | A | * | 2/1933 | Hutcheson | 52/667 |
| 1,909,711 | A | | 5/1933 | Lagaard | |
| 2,069,391 | A | * | 2/1937 | Sample | 52/668 |
| 2,121,173 | A | * | 6/1938 | Macpherson | 47/33 |
| 2,205,758 | A | | 6/1940 | Clark | |
| 2,315,448 | A | | 3/1943 | Nagin et al. | |
| 2,437,186 | A | | 3/1948 | Collins | |
| 2,454,583 | A | | 11/1948 | Wisely | |
| 2,639,011 | A | | 5/1953 | Peterson | |
| 3,050,162 | A | * | 8/1962 | Zingone | 52/666 |
| 3,616,111 | A | | 10/1971 | Raech, Jr. | |
| 3,762,124 | A | | 10/1973 | De Jonge | |
| 3,807,116 | A | * | 4/1974 | Flynn | 52/793.11 |
| 3,878,638 | A | | 4/1975 | Benjamin | |
| 4,005,943 | A | | 2/1977 | Devenish et al. | |
| 4,168,924 | A | | 9/1979 | Draper et al. | |
| 4,288,175 | A | | 9/1981 | Baker et al. | |
| 4,358,047 | A | | 11/1982 | Raubenheimer | |
| 4,372,086 | A | | 2/1983 | Hanlon | |
| 4,384,810 | A | | 5/1983 | Neumann | |
| 4,448,571 | A | | 5/1984 | Eckels | |
| 4,452,025 | A | | 6/1984 | Lew | |
| 4,502,815 | A | | 3/1985 | Scales et al. | |
| 4,555,201 | A | | 11/1985 | Paoluccio | |
| 4,572,705 | A | | 2/1986 | Vignon et al. | |
| 4,785,604 | A | * | 11/1988 | Johnson, Jr. | 52/668 |
| 4,797,026 | A | | 1/1989 | Webster | |
| 4,945,689 | A | * | 8/1990 | Johnson, Jr. | 52/668 |
| 5,076,546 | A | * | 12/1991 | Henry | 256/24 |
| 5,250,340 | A | | 10/1993 | Bohnhoff | |
| 5,459,971 | A | * | 10/1995 | Sparkman | 52/426 |
| 5,604,949 | A | | 2/1997 | Mangone | |
| 5,797,236 | A | * | 8/1998 | Posey et al. | 52/664 |
| 5,806,121 | A | | 9/1998 | Mangone | |
| 5,839,243 | A | * | 11/1998 | Martin | 52/439 |
| 5,864,910 | A | | 2/1999 | Mangone | |
| 6,390,154 | B1 | | 5/2002 | Hall | |
| 6,581,249 | B1 | | 6/2003 | Savicki et al. | |
| 6,684,591 | B2 | | 2/2004 | Jean | |
| 6,817,806 | B1 | * | 11/2004 | Arellanes | 405/114 |

FOREIGN PATENT DOCUMENTS

| | | |
|---|---|---|
| DE | 660199 | 4/1938 |
| DE | 8015458.1 | 12/1983 |
| EP | 0039448 | 4/1981 |
| EP | 0048006 | 9/1981 |
| FR | 1244800 | 9/1960 |
| NL | 6708323 | 12/1967 |
| WO | 84/02913 | 8/1984 |

OTHER PUBLICATIONS

Mitchell et al., "Analysis of Grid Cell Reinforced Pavement Bases", Technical Report GL-79-8, Department of Civil Engineering, University of California, Berkeley, California, Jul. 1979, 66 pages.

Webster, S. L., "Investigation of Beach Sand Trafficability Enhancement Using Sand-Grid Confinement and Membrane Reinforcement Concepts; Report 1: Sand Test Sections 1 & 2", Technical Report GL-79-20, Geotechnical Laboratory, U.S. Army Engineer Waterways Experiment Station, Vicksburg, Mississippi, Nov. 1979, 132 pages.

Webster, S. L., "Investigation of Beach Sand Trafficability Enhancement Using Sand-Grid Confinement and Membrane Reinforcement Concepts; Report 2: Sand Test Sections 3 & 4", Technical Report GL-79-20, Geotechnical Laboratory, U.S. Army Engineer Waterways Experiment Station, Vicksburg, Mississippi, Feb. 1981, 99 pages.

Cella et al., "Experiments in Mouridah and Kalumba for Stabilizing Clayey and Dune Sands Used in Structural Layers", United Nations Development Programme (UNDP), Office for Project Execution, Republic of Mali, Oct. 1982, 42 pages.

Arellanes, et al., "Development and Preliminary Evaluation of a Rapid Deployment Fortification Wall", Dec. 1985, 14 pages.

Crowe, et al., "The Protection and Rehabilitation of Dams Using Cellular Confinement Systems", Aug. 1995, 9 pages.

Hayes, P. G., "Expedient Field Fortifications Using Sand-Grid Construction", Technical Report SL-88-39, Department of the Army, Waterways Experiment Station, Corps of Engineers, Vicksburg, Mississippi, Oct. 1988, 6 pages.

* cited by examiner

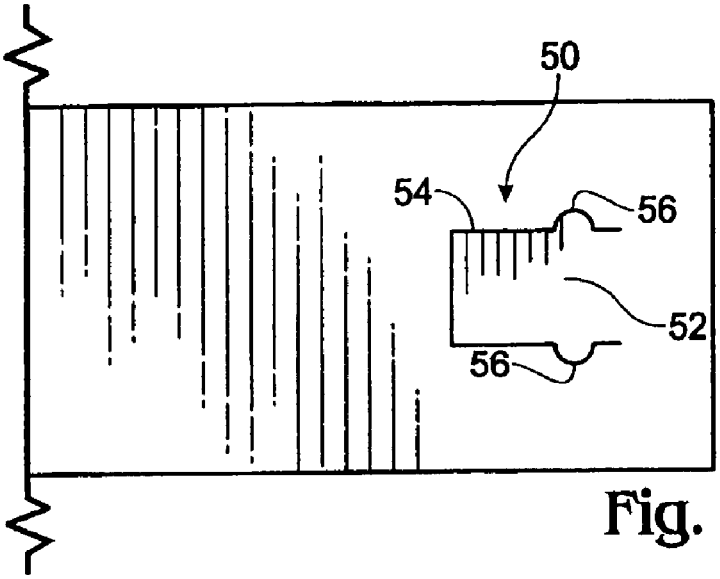
Fig. 8
Fig. 9
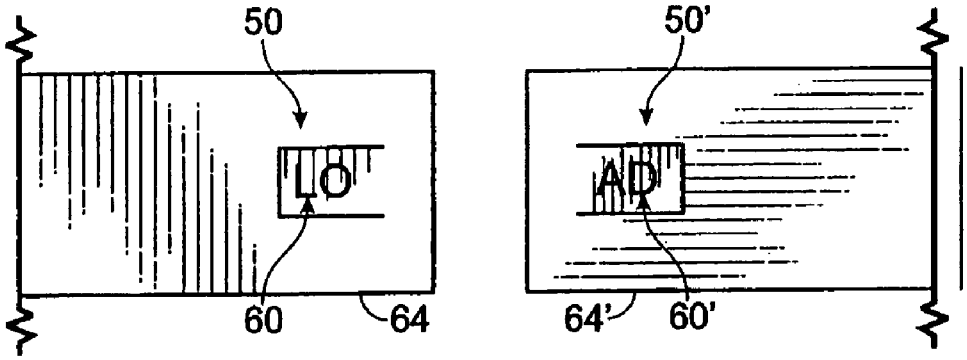
Fig. 10
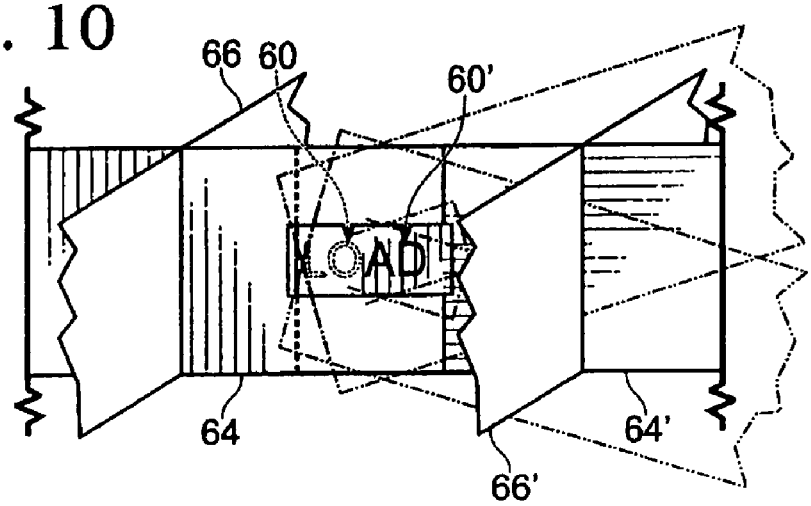

FLUENT MATERIAL CONFINEMENT SYSTEM

CROSS-REFERENCE TO RELATED APPLICATIONS

This application is a continuation of U.S. patent application Ser. No. 11/187,342, filed Jul. 21, 2005 now abandoned, which is a continuation-in-part of PCT Patent Application Serial No. PCT/US2004/043046, filed Dec. 20, 2004, which claims priority from U.S. Provisional Patent Application Ser. No. 60/583,309, filed Jun. 25, 2004, and U.S. patent application Ser. No. 10/741,801, filed Dec. 18, 2003. The parent application (U.S. patent application Ser. No. 11/187,342) is also a continuation-in-part of U.S. patent application Ser. No. 10/984,266, filed Nov. 8, 2004, which is a divisional of U.S. Pat. No. 6,817,806, which is a continuation of U.S. patent application Ser. No. 10/086,772, filed Feb. 28, 2002 now abandoned, which claims priority from U.S. Provisional Patent Applications Ser. No. 60/272,128, filed on Feb. 28, 2001, and Ser. No. 60/274,738, filed on Mar. 9, 2001. These applications are incorporated herein by reference in their entirety for all purposes.

TECHNICAL FIELD

The present disclosure relates to a fluent material confinement system configured to be easily deployable in low visibility conditions and/or rapidly joinable to adjacent fluent material confinement systems to form an extended structure.

BACKGROUND

Sandbags find use in many different situations. For example, sandbags may be used to hold back flood waters, to protect soldiers from bullets, artillery, etc. on the battlefield, and to protect structures such as buildings, camps, etc. from explosive devices.

While sandbag walls may provide a measure of protection in such circumstances, they also may have several drawbacks. For example, the construction of a sandbag wall may require a large number of people, and may take an excessive amount of time to fill the bags and arrange them into a barrier structure. Also, a sandbag wall may have points of weakness, as the individual sandbags are generally merely stacked upon one another, rather than being attached to one another. Furthermore, the sandbags are generally not reusable. Thus, they may require an expensive and time-consuming disposal process, and new ones may need to be purchased after each emergency event in anticipation of future emergency events.

Modular systems for forming temporary barrier structures are also known. For example, U.S. Pat. Nos. 4,785,604 and 4,945,689 to Johnson, Jr. disclose collapsible grid structures for forming temporary barriers. The grids are formed from a plurality of latitudinal and longitudinal strips connected in an interwoven fashion. The grids are configured to be connected to adjacent grids in both stacked and side-by-side manners, and then filled with a material such as sand to form the temporary barrier. The grids may allow a temporary barrier structure to be assembled more quickly and with less manpower than a comparable sandbag structure.

The grids disclosed in Johnson are joined in a side-by-side manner via connector slots formed in the ends of the latitudinal and the longitudinal strips. The connector slots extend into the strip from the either the top of the strip or from the bottom of the strip. To connect a grid to an adjacent grid, the grids are arranged side-by-side in such an orientation that the connector slots that extend from the top of the strips on the grid are aligned with complementary slots on the adjacent grid that extend from the bottom of the strips, and vice versa. The connector slots are then coupled with the complementary slots to join the grids.

While the grids disclosed in Johnson offer improvements over the use of traditional sandbags to form temporary barrier structures, they also may suffer some shortcomings. For example, the connector slots may be difficult to connect in inclement conditions, as it may be difficult to determine the correct grid orientation in which the connector slots line up with the correct complementary slots. Likewise, it may be difficult to determine whether complementary slot connectors are securely connected.

Additionally, the ends of the strips of the grids disclosed in the Johnson, Jr. patents may tend to dog-ear when the cells formed at the boundary between adjacent grids are filled with a fluent material due to the connector slots. This may prevent these cells from being entirely filled with fluent material, and thus may introduce a structural weakness into the barrier wall that may potentially cause catastrophic failure under extreme conditions. Another potential problem with the Johnson grid is that it may be difficult to stack a plurality of grids to form a wall under low visibility conditions and/or without undergoing training to learn how to spot and fix an incorrectly stacked wall. Additionally, the strips of the Johnson grid terminate in ninety degree corners that may impede the smooth movement of the grid between collapsed and deployed configurations.

SUMMARY

A fluent material confinement system configured to receive a granular fluent material to form a temporary barrier structure is disclosed, wherein the fluent material confinement system includes a plurality strips, the plurality of strips including a plurality of lengthwise strips and a plurality of widthwise strips coupled with each other to define a plurality of open cells, wherein the plurality of lengthwise strips includes at least one wider lengthwise strip configured to extend into cells of a next-lowest fluent material confinement system when the fluent material confinement system is stacked on the next-lowest fluent material confinement system, and a stacking error indicator associated with the wider lengthwise strip, wherein the stacking error indicator is configured to be effective in low visibility conditions to indicate to a user a location of an error in stacking of the fluent material confinement system on the next-lowest fluent material confinement system.

BRIEF DESCRIPTION OF THE DRAWINGS

FIG. 8 is a side elevational view of an alternate embodiment of a connecting structure suitable for connecting adjacent fluent material confinement systems together.

FIG. 9 is a side elevational view of another alternative embodiment of a connecting structure, along with a complementary connecting structure from an adjacent fluent material confinement system.

FIG. 10 is a side elevational view of the connecting structure and corresponding connecting structure of FIG. 9 connected together, with an exemplary range of articulation shown in dashed lines.

DETAILED DESCRIPTION OF THE DEPICTED EMBODIMENTS

Figure 1:
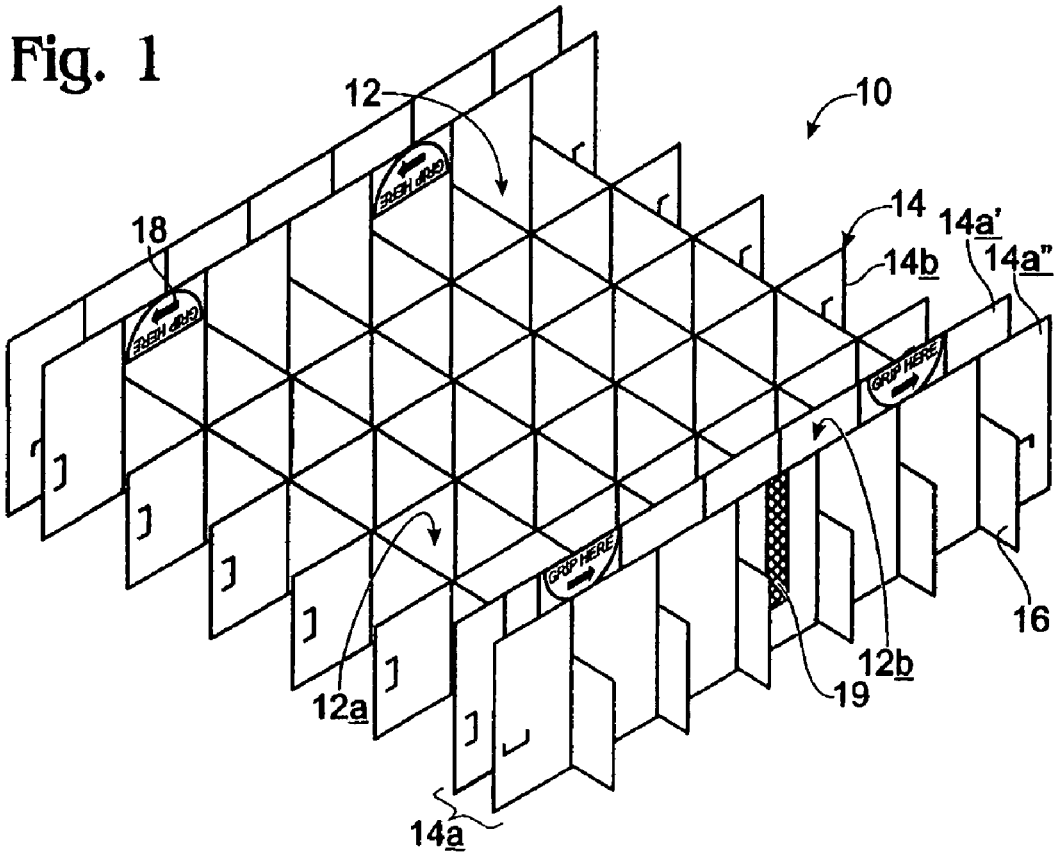
FIG. 1 is an isometric view of a fluent material confinement system according to a first embodiment.

FIG. 1 shows, generally at 10, a first embodiment of a fluent material confinement system. Fluent material confinement system 10 is formed from a plurality of elongate, generally strip-shaped members coupled together in such a manner as to define an array of open-ended cells 12. The plurality of strip-shaped members includes a plurality of lengthwise strips 14, and a plurality of widthwise strips 16. Lengthwise strips 14 may include strips of a first, greater width 14*a*, and strips of a second, lesser width 14*b*. Lengthwise strips 14 may also include strips with different types of connectors, as described in more detail below. The depicted arrangement of lengthwise strips 14 and widthwise strips 16 defines at least two different types of cells, interior cells 12*a* and exterior border cells 12*b*. Furthermore, the depicted arrangement of strips allows fluent material confinement system 10 to be movable between an open configuration (shown in FIG. 1) and at least one collapsed configuration (described in more detail below), and may include one or more deployment indicators 18 to assist in the movement of the system from the collapsed configuration to the open configuration.

Cells 12 are configured to receive a suitable granular fluent material, typically sand, and to prevent the fluent material from flowing or shifting a significant amount under horizontal or vertical loading. This results in the formation of a mechanically strong, sturdy structure. A plurality of fluent material confinement systems 10 may be stacked and/or arranged side-by-side (or end-to-end) and then filled with a granular fluent material to construct any desired barrier structure. For example, as mentioned above, a plurality of fluent material confinement systems 10 may be arranged in a wall-shaped configuration and then filled with a fluent material to form a flood or wave barrier. Additionally, a plurality of fluent material confinement systems 10 may also be used as an emergency mudflow barrier, a support inside the core of an earthen levee structure or sand dune, or may be used to form revetments for battlefields, and other such ballistic structures.

Fluent material confinement system 10 meets several important design criteria not met in full by any prior systems. For example, fluent material confinement system 10 may be stacked to hold fill material to a height of six feet, or even greater. Also, the fluent material system may be fill either manually or mechanically. Additionally, fluent material confinement system 10 keeps sand or other small-grained fluent material confined within the stacked structure for the intended life of the structure, for example, six months or greater. Fluent material confinement system 10 is easily and rapidly deployable by just two persons, and requires little or no additional equipment to erect. System 10 also provides cost advantages over the construction of a sandbag wall, and provides a greater amount of protection than prior systems. Finally, system 10 is able to conform to the geography and geometry of the area in which it is placed, and is readily transportable in a cost effective manner. The structural features that give rise to these advantages are described in more detail below.

Turning again to the basic structure of fluent material confinement system 10, lengthwise strips 14 and widthwise strips 16 may have any suitable length. Typically, lengthwise strips 14 and widthwise strips 16 have a length in the range from three to six feet, and more typically approximately 4 feet, although they may have a length outside of these ranges as well. In the embodiment of FIG. 1, lengthwise strips 14 and widthwise strips 16 have approximately the same length. However, it will be appreciated that lengthwise strips of different lengths than the widthwise strips may also be used.

Wider lengthwise strips 14*a* assist in the stacking of fluent material confinement systems 10. When stacking fluent material confinement systems 10, the bottommost fluent material confinement system is placed on the ground with the wider lengthwise strips 14*a* extending upwardly past the top edges of narrower lengthwise strips 14*b*. Then, each subsequent fluent material confinement system 10 is staked in an upside-down configuration on top of the next-lower fluent material confinement system. In this manner, the wider lengthwise strips 14*a* of the bottommost fluent material confinement system 10 extends upwardly into the cells of the next-highest fluent material confinement system. This helps hold the next-highest fluent material confinement system 10 in place relative to the bottommost fluent material confinement system, and helps to reinforce the cells into which the wider lengthwise strips 14*a* extend. Likewise, the wider lengthwise strips 14*a* of each subsequent fluent material confinement system 10 extends downwardly into the next-lower fluent material confinement system, again reinforcing the cells and helping to hold the fluent material confinement systems in place relative to one another. In this manner, an extended barrier structure may be constructed using a plurality of fluent material confinement systems 10 and no other additional pieces of other configurations, thereby simplifying the construction of an extended barrier structure, particularly under high-stress or difficult conditions (although pieces having other configurations may be used in combination with system 10 if desired, as described in more detail below).

The use of two wider lengthwise strips 14*a* as the outermost strips on each side of the fluent material confinement system form a network of barrier cells that help to prevent fluent material from leaking out of barrier cells 12*b*, thus preventing failure caused by sand leaking out from between the outermost strips of adjacent grid layers, and thus prolonging the life of a temporary barrier. Sand that is added to barrier cells 12*b* is not able to escape either outside of the fluent material confinement system, or to inner cells 12*a* of the fluent material confinement system, helping to maintain the integrity of a structure built with the fluent material confinement system. This is opposed to prior fluent material confinement systems, which may allow sand to escape from the outer cells and thus lead to a danger of catastrophic failure of the barrier.

Sand in the interior cells, however, is free to shift between cells at the boundaries between vertically stacked fluent material confinement systems because the strips forming these cells do not overlap with the strips of vertically adjacent cells. Furthermore, because narrower lengthwise strips 14*b* and widthwise strips 16 do not extend into the cells of vertically adjacent grids, these strips are free to be pushed out of alignment compared to the strips of the vertically adjacent grids. This also helps to allow sand to flow laterally through the grids, rather than forming distinct columns of sand that extend throughout the structure. The lateral flow of sand through the structure helps to ensure that no voids form in the structure due to loss of sand, and thus helps to prevent catastrophic failure due to weak spots caused by sand loss in isolated cells. As the sand flows into voids over time, more sand can be added to the top of the structure to ensure that the entire structure is filled to the top with sand.

Furthermore, the horizontal movement of sand through the structure helps to ensure that all cells are filled evenly and completely with sand during the initial filling of a barrier structure built with a plurality of fluent material confinement systems 10. Sand entering from the top of the barrier is able to move laterally into adjoining cells as the barrier is filled. Once the sand reaches the base of the barrier, the weight of the sand above causes the sand below to distribute evenly along the ground and to compact into an efficient packing.

Fluent material confinement system 10 may also include a vertical alignment indicator 19 disposed on a selected strip. Vertical alignment indicator 19 may help a user to determine the orientation of fluent material confinement system 10 in inclement weather or other low visibility conditions. Furthermore, vertical alignment indicator 19 of an upper fluent material confinement system in a stacked arrangement can be aligned with the vertical alignment indicator of a next-lowest fluent material confinement system to ensure the two fluent material confinement systems are in a correct orientation relative to one another.

As mentioned above, a fluent material confinement system as disclosed herein may configured to be attachable to other fluent material confinement systems in a side-by-side arrangement. Thus, a suitable connecting or supporting structure (or structures) may be provided to enable a plurality of fluent material confinement systems to be connected in this manner.

Figure 2:
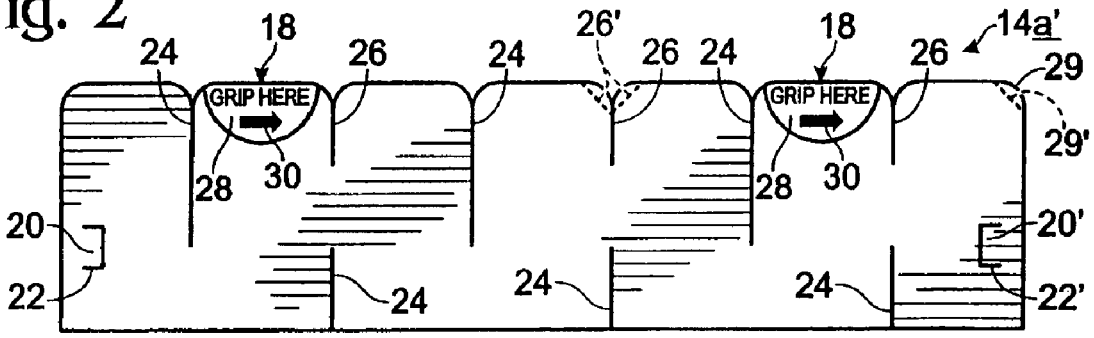
FIG. 2 is a side elevational view of a first wider lengthwise strip of the embodiment of FIG. 1.
Figure 3:
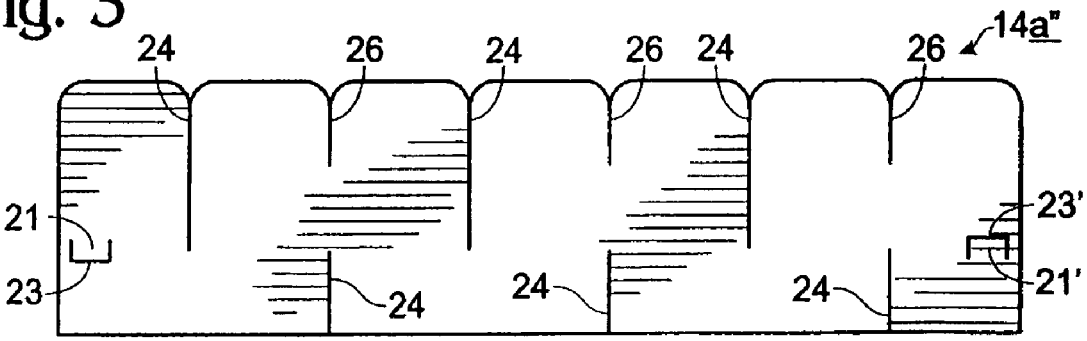
FIG. 3 is a side elevational view of a second wider lengthwise strip of the embodiment of FIG. 1.

In the embodiment of FIG. 1, the wider lengthwise strips 14*a* have two different types of connecting structures. These are shown in more detail in FIGS. 2 and 3. FIG. 2 shows the second-to-outermost lengthwise strips 14*a*' of fluent material confinement system 10, and FIG. 3 shows the outermost lengthwise strips 14*a*" of fluent material confinement system 10. In these figures, the second-to-outermost lengthwise strips 14*a*' are referred as strips 14*a*', and the outermost strips are referred to as strips 14*a*".

Referring first to FIG. 2, wider lengthwise strip 14*a*' includes a connecting structure in the form of a tongue 20. Wider lengthwise strip 14*a*' has a tongue 20 on each end of the strip, but it will be appreciated that the strip alternatively may have a tongue on only one end where suitable.

Tongue 20 may be formed in any suitable manner. The depicted tongue 20 is formed from a generally "U"-shaped cut, slot, or other aperture 22 formed in each end of wider lengthwise strip 14*a*'. However, tongue 20 may be formed from any other shape slot, for example, a "V"-shaped slot or a substantially straight slot. Furthermore, tongue 20 may be formed from a suitably shaped tab that is joined to wider lengthwise strip 14*a*' by an adhesive, a weld, etc. Where a substantially straight slot is used as a connecting structure, the slot preferably does not extend to an edge of the strip, but instead is wholly contained within the end of the strip. This may help prevent the ends of the strip from dog-earing when the cells are filled with a fluent material.

Likewise, tongue 20 may have any suitable orientation. The depicted tongues 20 point inwardly, and extend generally parallel to a long dimension of wider lengthwise strip 14*a*', which is the dimension that extends from one tongue 20 to the other tongue 20'. Wider lengthwise strip 14*a*' is joined to a complementary wider lengthwise strip on an adjacent fluent material confinement system by inserting tongue 20 into the slot 22' of the adjacent fluent material confinement system, and then pulling the strips in such a manner as to extend tongue 20 fully into slot 22'. Other examples of suitable tongue orientations are discussed in more detail below.

Referring next to FIG. 3, each wider lengthwise strip 14*a*" includes a tongue 21 and associated slot 23 oriented generally perpendicular to the long dimension of the strip disposed at one end of the strip. Wider lengthwise strip 14*a*" also includes a complementary tongue 21' and associated slot 23' located at the other end of the strip. Wider lengthwise strip 14*a*" is joined to an adjacent wider lengthwise strip 14*a*" by inserting tongue 21 into slot 23' (or inserting tongue 21' into slot 23) on an adjacent fluent material confinement system.

The use of the different orientations of tongue 21 and tongue 20 on a single fluent material confinement system 10 may help to hold adjacent fluent material confinement systems together more securely than either would alone. For example, when both tongues 20 and 21 are connected to complementary connecting structures on an adjacent fluent material confinement system, the orientation of tongue 20 may help to resist vertical displacement of adjacent fluent material confinement systems that may disconnect tongue 21 from an adjacent slot 23', while the orientation of tongue 21 may help to prevent horizontal displacements that may disconnect tongue 20 from the adjacent slot 22'. While the wider lengthwise strips 14*a*' and 14*a*" are depicted as having different connecting structures, it will be appreciated that all lengthwise strips may also have the same connecting structure, or any other combination of suitable connecting structures.

As with tongue 20, tongue 21 may be formed in any suitable manner. The depicted tongue 21 is formed from a generally "U"-shaped slot 23 in an end of wider lengthwise strip 14*a*", but may be formed in any other suitable manner, including, but not limited to, those listed above for tongue 20.

The use of tongues 20 and 21, as opposed to the slot connectors of prior systems, also helps to avoid orientation problems during assembly of a barrier, as adjacent fluent material confinement systems 10 will connect and nest in a plurality of different orientations when stacked.

Each wider lengthwise strip 14*a* also typically includes other slots (or other like structures) of one or more different types disposed along the length of the strip. Each type of slot typically is provided for a particular purpose. For example, some of the slots on wider lengthwise strip 14*a* are widthwise-strip-receiving slots 24 configured to accommodate the insertion of widthwise strips 16. Widthwise-strip-receiving slots 24 allow lengthwise strips 14 and widthwise strips 16 to be coupled together to form fluent material confinement system 10. Widthwise-strip-receiving slots 24 are configured to nest within complementary lengthwise strip-receiving slots on widthwise strips 16, as described in more detail below.

Widthwise-strip-receiving slots 24 may be oriented perpendicular to the long dimension of wider lengthwise strip 14*a*, or may have any other suitable orientation. Additionally, widthwise-strip-receiving slots 24 may extend sufficiently far into the width of wider lengthwise strip 14*a* so that the top edges of all widthwise strips 16 coupled with a selected wider lengthwise strip are approximately level with the top edges of narrower lengthwise strips 14*b*. Thus, widthwise-strip-receiving slots 24 that extend downwardly from the top edge of wider lengthwise strip 14*a* may extend further into the width of the wider lengthwise strip than the widthwise-strip-receiving slots that extend upwardly from the bottom edge of the wider lengthwise strip.

Widthwise-strip-receiving slots 20 may have any desired spacing, and the spacing of widthwise-strip-receiving slots 24 may be selected based on any desired criteria. For example, spacing the strips more closely together may form smaller cells 12, which may provide a somewhat stronger structure. However, this also may require the use of more materials to make fluent material confinement system 10, and thus may increase manufacturing costs. Likewise, spacing the strips further apart may decrease the cost and weight of fluent material confinement system 10 per unit area, but may be somewhat less strong than a fluent material confinement system with smaller cells. Typically, widthwise-strip-receiving slots 20 are spaced between four and twelve inches apart, and more typically approximately seven inches apart, but it will be appreciated that the widthwise-strip-receiving slots may also be spaced by a distance outside of these ranges.

Widthwise-strip-receiving slots may be evenly spaced along the length of wider lengthwise strip 14*a*, or may be spaced in an uneven manner. In the depicted embodiment, widthwise-strip-receiving slots 20 are spaced evenly, and alternately extend from the top edge and bottom edge of wider lengthwise strip 14*a*. The even spacing of widthwise-strip-receiving slots 20 creates cells of uniform dimensions, and may thus contribute to the regularity of the structural properties of fluent material confinement system 10. Furthermore, the alternating arrangement of widthwise-strip-receiving slots 20 allows the wider lengthwise strips and widthwise strips 16 to be interwoven, helping to hold fluent material confinement system 10 together during storage or transport. The interwoven structure of fluent material confinement system 10 also may allow the fluent material confinement system to be collapsed into at least two different collapsed configurations, as described in more detail below.

Besides widthwise-strip-receiving slots 24, wider lengthwise strip 14*a* also may include a plurality of stacking slots 26 to accommodate the stacking of fluent material confinement systems 10. Stacking slots 26 are configured to receive the widthwise strips of a next-higher fluent material confinement system 10. This helps to stabilize the upper fluent material confinement system, and also allows both the widthwise strips 16 and the narrower lengthwise strips 14*b* of the upper system to rest substantially fully against the widthwise strips and narrower lengthwise strips of the lower system when the systems are stacked. It will be appreciated that widthwise-strip-receiving slots 24 that extend from the top edge of wider lengthwise strips 14*a* may also function as stacking slots.

Wider lengthwise strips 14*a* may have any suitable width relative to narrower lengthwise strips 14*b* and widthwise strips 16. For example, wider lengthwise strips 14*a* may have a width of between ten and fourteen inches, and more typically approximately 12 inches, while narrower lengthwise strips 14*b* and widthwise strips 16 may have a width of between six and ten inches, and more typically approximately 8 inches. Furthermore, while fluent material confinement system 10 is shown as including eight lengthwise strips 14 and six widthwise strips 16, a fluent material confinement system may include any other suitable number of lengthwise strip and/or widthwise strips.

The depicted wider lengthwise strips 14*a*' and 14*a*" also both include rounded or beveled outer corners 29. Rounded corners 29 help to ensure the smooth deployment of fluent material confinement system 10 between the collapsed and deployed configurations, as it has been found that the use of square corners (as used in prior systems, such as the Johnson grids) cause the structures to hang up during deployment, which can greatly slow the construction of an extended barrier structure in situations where fast deployment speeds are critical. It will be noted that only the upper corners of the wider lengthwise strips are rounded in the depicted embodiment, and that the lower corners 29' are not rounded (the terms "upper" and "lower" as used herein define the position of the corners when the strips are in the orientation of FIGS. 2 and 3, and not in other orientations). This is because rounding the lower corners may allow fluent material to flow out of the bottom of a barrier structure constructed with system 10 due to the space that the rounded corners may open between the strip and the underlying ground or other surface. The term "rounded" as used herein includes any curved profile with a consistent or variable radius of curvature, beveled profiles with a plurality of angles separated by straight segments such that the individual angles are each less than ninety degrees and the sum of the angles equals approximately ninety degrees (for example, as illustrated in dashed lines at 29' in FIG. 2), and combinations of rounded and beveled profiles.

Likewise, the corners at each slot 24 and 26 are rounded along the upper edges of strips 14' and 14", but are not rounded at the slots along the lower edges in the depicted embodiment. Rounding the corners along the upper edges help to ease the stacking of the grids, as the shape created by the rounding tends to direct the strips of a next-highest stacked grid into the correct slots on a next-lowest stacked grid. Likewise, not rounding the corners along the lower edges helps to prevent fluent material from leaking out of the space between the rounded corners and an underlying surface, and thereby helps to prevent failure of the system when under stress of waves, artillery impacts, etc. However, it will be appreciated that the lower outer corners or inner corners (where the bottom slots meet the bottom edges) may be rounded if desired. Furthermore, the upper corners may likewise be angled or beveled rather than (or in addition to) curved if desired.

The rounded corners on wider lengthwise strips **14*a*' and 14*a*"** may have any suitable radii of curvature. One example of a suitable radius of curvature is approximately one inch. Other suitable radii of curvature include values either larger or smaller than one inch.

During emergency operations, such as the construction of a flood-retaining wall, time is generally of the essence, and any time wasted trying to determine how to deploy an emergency system such as the fluent material confinement system may jeopardize property and/or lives. Thus, as mentioned above, fluent material confinement system 10 may include one or more deployment indicators 18 configured to be effective in low light conditions (or other adverse conditions) to instruct a user how to move the fluent material confinement system from at least one of the collapsed positions to the opened position.

A deployment indicator may enhance the operability of a fluent material confinement system in any desired manner. In the depicted embodiment, deployment indicators 18 indicate how fluent material confinement system 10 is to be moved from the closed position to the opened position via a visually enhanced instructional indicia disposed on wider lengthwise strips **14*a*. Deployment indicators 18 include a visibility enhancing background portion 28, and an indicating portion 30. Background portion 28 is typically formed from a reflective or fluorescent material to visually enhance the portions of fluent material confinement system 10 at which a user (or users) should hold the fluent material confinement system when deploying the system. Indicating portion 30 is typically contained at least partially within background portion 28**, and is configured to stand out against the background portion so that the instructions contained within the indicating portion may be easily read and followed.

Indicating portion 30 may include any suitable indicia for indicating how fluent material confinement system 10 is to be moved to the open configuration. For example, in the depicted embodiment, indicating portion 30 has a legend indicating where a user is to grip fluent material confinement system 10, and also has an arrow indicating which direction the user is to move the fluent material confinement system to move the system to the opened position. While deployment indicator 18 is configured to visually enhance the portions of fluent material confinement system 10 that are to be gripped by a user, it will be appreciated that deployment indicator 18 may function in any other suitable manner. For example, the deployment indicator may include a series of raised bumps or ridges to indicate where fluent material confinement system 10 is to be grasped via tactile enhancement.

Figure 4:
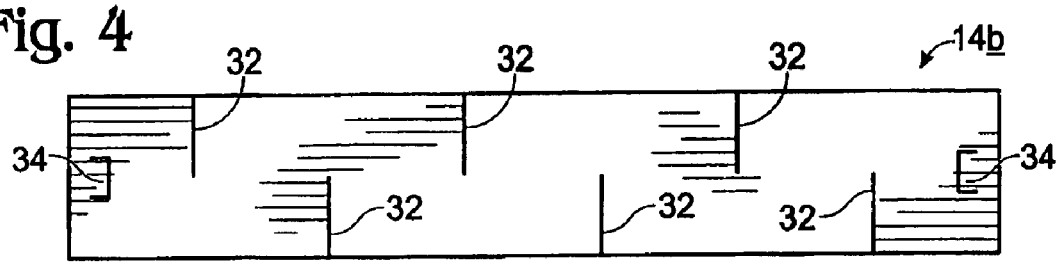
FIG. 4 is a side elevational view of a narrower lengthwise strip of the embodiment of FIG. 1.

Narrower lengthwise strip **14*b* is shown in more detail in FIG. 4. Like wider lengthwise strips 14*a*, narrower lengthwise strips 14*b* may include a plurality of slots of different types. For example, narrower lengthwise strips 14*b* may include a plurality of widthwise-strip-receiving slots 32 that allow the narrower lengthwise strips to be coupled with widthwise strips 16. In the depicted embodiment, widthwise-strip-receiving slots 32 alternately extend from the top and bottom edges of narrower lengthwise strips 14*b*, allowing narrower lengthwise strips 14*b* to be interwoven with widthwise strips 16. Alternatively, all widthwise-strip-receiving slots 32 may extend from the same edge of narrower lengthwise strips 14*b* if desired. Narrower lengthwise strips 14*b* also may include one or more connecting structures, such as tongues 34, configured to be coupled to a complementary slot on an adjacent fluent material confinement system. Tongues 34 may have any suitable orientation. For example, in the depicted embodiment, tongues 34 are oriented along a long axis of narrower lengthwise strip 14*b*, as described above for wider lengthwise strip 14*a*'**. Other examples of suitable tongue orientations are described below.

Figure 5:
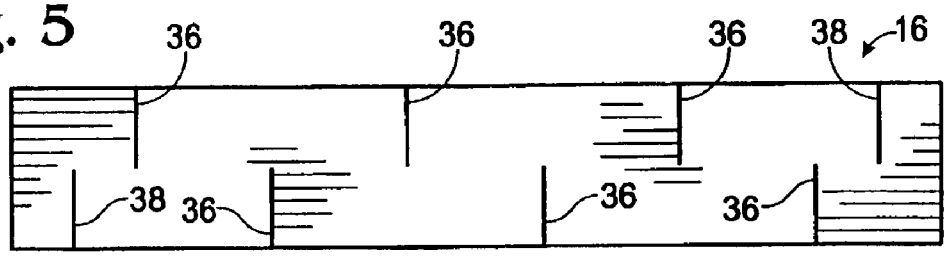
FIG. 5 is a side elevational view of a widthwise strip of the embodiment of FIG. 1.

FIG. 5 shows an exemplary widthwise strip 16 in more detail. Each widthwise strip 16 includes a plurality of lengthwise-strip-receiving slots 36 disposed along the length of the widthwise strip. Lengthwise-strip-receiving slots 36 are configured to be joined with widthwise-strip-receiving slots 20 in wider lengthwise strip **14*a*, and with widthwise-strip-receiving slots 32 in narrower lengthwise strip 14*b*. In the depicted embodiment, lengthwise-strip-receiving slots 36 extend alternately from the top edge and bottom edge of each widthwise strip 16 so that the widthwise strips may be interwoven with the lengthwise strips. However, lengthwise-strip-receiving slots 36 may also extend from only one edge of widthwise strips 16**.

Besides lengthwise-strip-receiving slots 36, widthwise strips 16 also may include border cell slots 38 formed in the ends of each widthwise strip. Border cell slots 38 are configured to receive an outer lengthwise strip 14 to create border cells **12*b*. Border cell slots 38 may be spaced any desired distance from the adjacent lengthwise-strip-receiving slot 34. In the depicted embodiment, each border cell slot 38 is spaced approximately half the distance from the nearest lengthwise-strip-receiving slot 36. This creates border cells 12*b* of a smaller volume than interior cells 12*a*, and thus may make border cells more rigid for improved resistance to forces generated by static water pressures and wave impacts. The end portions 39 of widthwise strip 16, extending from each border cell slot 38** to each end of the widthwise strip, helps to minimize any outward movement of the lengthwise strips during filling with sand and under the stresses of ordinary use.

The depicted narrower lengthwise strips **14*b* and widthwise strips 16 have no rounded outer corners. It has been found that the outer corners of these narrower strips tend not to hang on other strips during deployment, unlike wider lengthwise strips 14*a*' and 14*a*". Likewise, the inner corners formed where the slots meet the edges of these strips are not rounded in the depicted embodiment, as the narrower strips 14*b* and 16 do not nest into a next-lowest layer when assembled in a stacked extended structure. However, it will be appreciated that one or more corners of narrower lengthwise strip 14***b* and/or widthwise strip 16 may be rounded if desired.

The various strips that form fluent material confinement system 10 may be made from any suitable materials. Suitable materials include strong, flexible plastics that are lightweight and damage resistant. Such materials reduce the weight and increase the durability of fluent material confinement grid system 10. The materials should be able to resist wave impacts, static water pressure and sand pressures, yet be sufficiently flexible to be interwoven. Furthermore, the materials may be transparent or translucent to allow the level of sand within the fluent material confinement grid system to be easily monitored. Some examples of suitable materials are PET (poly(ethylene terephthalate)), PETG (a copolyester of 1,4-cyclohexanedimethanol-modified poly(ethylene terephthalate)), PCTG (poly(1,4-cyclohexylene dimethylene terephthalate)), polyvinyl chloride, and polycarbonates such as bisphenol A polycarbonate. In contrast, softer, more flexible materials such as high-density polyethylene may not have the necessary strength to withstand such conditions.

Fluent material confinement system 10 may be subjected to large stresses during some uses. For this reason, it may be desirable to form fluent material confinement system 10 from a material with relatively high resistance to stresses, relatively high hardness, etc. For example, the material from which fluent material confinement system 10 is formed may have a tensile stress yield point of 45 MPa or higher, a tensile stress break point of 52 MPa or higher, a flexural modulus of 1800 MPa or higher, a flexural strength of 66 MPa or higher, a Rockwell hardness of 103, and an impact resistance (puncture) of 42 J (energy at maximum load) or higher at room temperature. It will be appreciated that the materials strength characteristics listed above are merely exemplary, and that the material from which fluent material confinement system 10 is constructed may have any other suitable physical characteristics.

Many different additives may be used to modify the properties of these materials as needed. For example, UV absorbers may be added as either a starting material or as a coating on the finished product to increase the resistance of the material to UV degradation. Other possible additives include impact modifiers to increase impact resistance, and flexural modifiers to adjust the stiffness of the materials.

Figure 6:
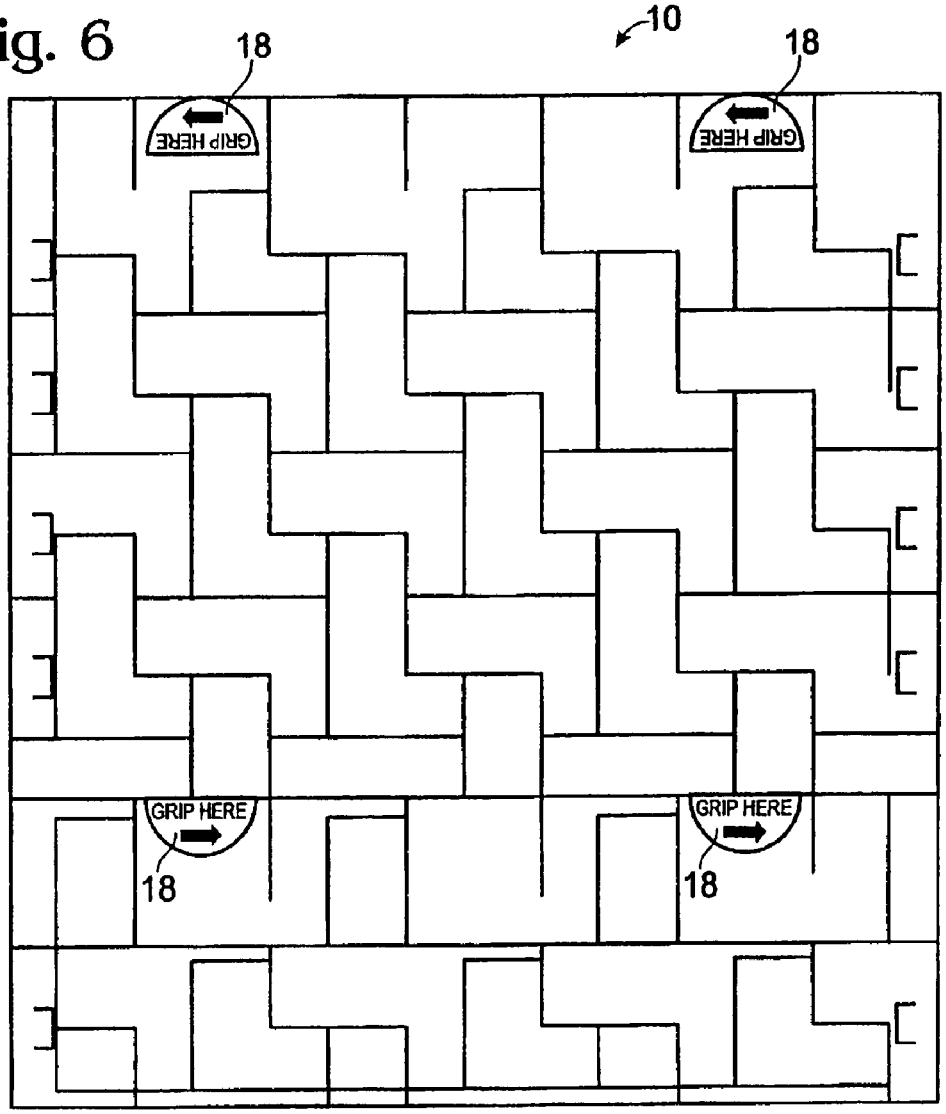
FIG. 6 is a perspective view of the embodiment of FIG. 1 in a first collapsed configuration.

As mentioned above, fluent material confinement system 10 is configured to be collapsible into at least one collapsed configuration for ease of storage and transport. FIG. 6 shows a first collapsed configuration of fluent material confinement system 10, in which the fluent material confinement system is collapsed down to a substantially flat sheet-like shape. In the configuration of FIG. 6, a large number of fluent material confinement systems 10 may be stacked in a relatively small amount of space for palletized storage. Furthermore, in this configuration, deployment indicators 18 are disposed on the top surface of fluent material confinement system 10, in plain view of users who are deploying the system. Thus, the users can easily determine where to grip and how to open fluent material confinement system 10 with only a quick glance at the system.

Figure 7:
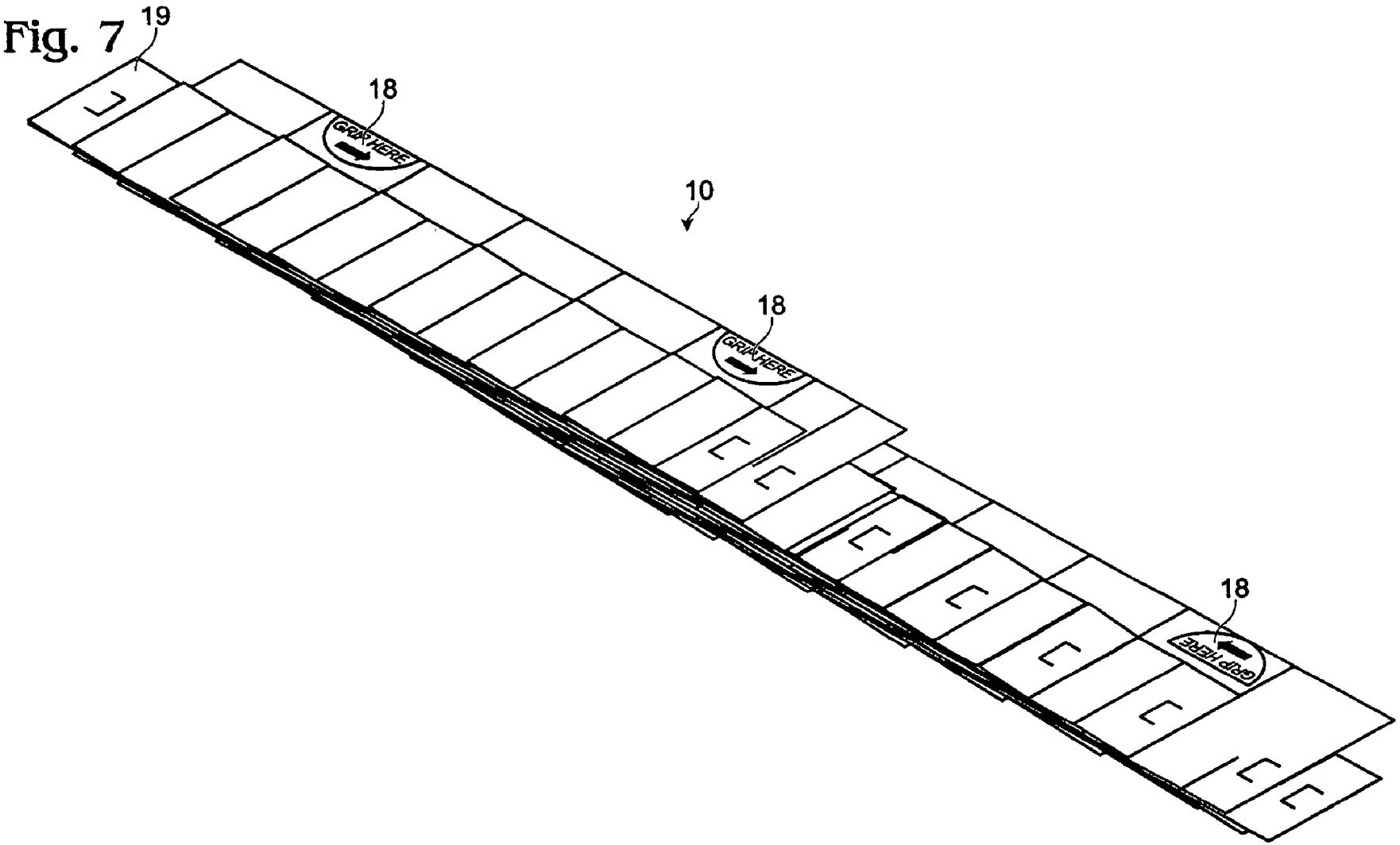
FIG. 7 is a perspective view of the embodiment of FIG. 1 in a second collapsed configuration.

FIG. 7 shows a second possible collapsed configuration for fluent material confinement system 10. In this configuration, fluent material confinement system 10 is collapsed into a narrow structure of the same width as wider lengthwise strips 14*a*. Just as with the collapsed configuration of FIG. 6, deployment indicators 18 may be configured to indicate where a user is to grip fluent material confinement system 10 to deploy the system, as well as the direction in which the system is to be moved for deployment.

Fluent material confinement system 10 occupies only a small amount of space when in the collapsed configuration of FIG. 6. Thus, a plurality of fluent material confinement systems 10 may be easily stored in a side-by-side and stacked arrangement when in the collapsed configuration of FIG. 6 for palletized storage.

FIG. 8 shows, generally at 50, an alternate embodiment of a connecting structure suitable connecting adjacent fluent material confinement systems together. Connecting structure 50 includes a tongue 52 formed from a slot or cut 54 in the end of the strip, and is configured to extend through a complementary slot on an adjacent fluent material confinement system. Tongue 52 also includes at least one projection 56 formed in an edge of the tongue. Projection 56 is configured to fit behind, and thus engage, a complementary projection on a complementary connecting structure to secure tongue 52 in the complementary slot. The depicted connecting structure 50 includes two projections 56—one on each side of tongue 52. However, it will be appreciated that connecting structure 50 may also have either more or fewer projections.

A connecting structure may also include a connection indicator to indicate to a user that a fluent material confinement system and adjacent fluent material confinement system are securely connected. Typically, the connection indicator operates in combination with a complementary connection indicator on the adjacent fluent material confinement system to form an indication that a connection is secure only when the connection indicator and the complementary connection indicator are properly connected. Any suitable type of indication may be formed by the connection indicator and complementary connection indicator. Examples include, but are not limited to, visual and/or tactile indications.

FIGS. 9 and 10 show one example of a suitable connection indicator generally at 60, and a complementary connection indicator generally at 60'. Connection indicator 60 and complementary connection indicator 60 each includes one or more alphanumeric characters. The alphanumeric characters are configured to combine with the complementary alphanumeric characters to form a recognizable word, phrase, acronym, etc. when connecting structure 50 and complementary connecting structure 50' are connected in a correct manner. In the depicted embodiment, connection indicator 60 includes the letters "LO", and complementary connection indicator 60' includes the letters "AD." When connecting structured 50 and 50' are connected properly, tongue 52 extends far enough into the complementary slot for these letters to spell out the word "LOAD," telling a user that the fluent material confinement systems are correctly connected and ready to be loaded with a fluent material. The use of a translucent or transparent material to form fluent material confinement system 10 may facilitate the use of connection indicator 60 and complementary connection indicator 60'.

FIG. 10 also illustrates the capability of fluent material confinement system 10 to articulate relative to the adjacent fluent material confinement system. Due to the configuration and placement of connecting structure 50 and complementary connecting structure 50' on their respective strips (indicated in FIGS. 9 and 10 as 64 and 64', respectively), the end of strip 64 is spaced from a closest perpendicular strip, indicated at 66', on the adjacent fluent material confinement system. Likewise, the end of strip 64' is also spaced from a closest widthwise strip, indicated at 66. Because the ends of strips 64 and 64' are not close to or against widthwise strips 66, strip 64' is able to articulate relative to strip 64', as shown in FIG. 10. This allows a plurality of fluent material confinement systems 10 to be used to cover uneven terrain without significant distortion of any individual fluent material confinement system.

Fluent material confinement system 10 may be configured to have any suitable range of articulation. The range of articulation permitted between adjacent fluent material confinement systems may be tailored by varying the distance between the ends of strips 64 and 64' and the nearest widthwise strips 66 and 66', as the fluent material confinement system typically can articulate until a corner of the end of strip 64 contacts strip 66' (or a corner of strip 64' contacts strip 66). Alternatively, the range of articulation may be tailored by adjusting the width of the strips.

Figure 11:
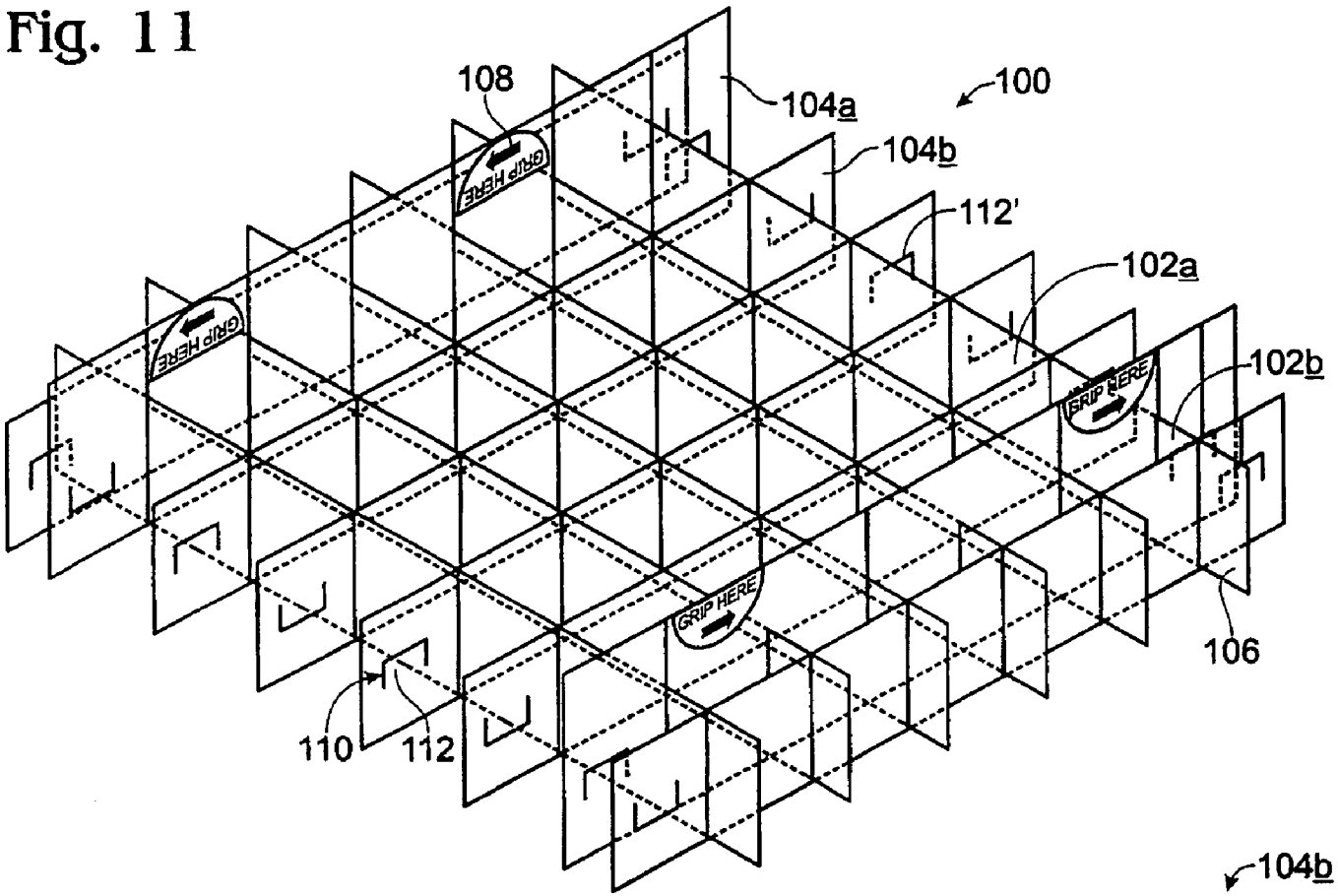
FIG. 11 is an isometric view of a fluent material confinement system according to a second embodiment.

FIG. 11 shows, generally at 100, a second embodiment of a fluent material confinement system, with different connecting structures than fluent material confinement system 10. Fluent material confinement system 100 has many of the same features as fluent material confinement system 10. For example, fluent material confinement system 100 includes a plurality of interior cells 102*a* bordered by a plurality of border cells 102*b* formed from an interconnected network of lengthwise strips 104 and widthwise strips 106. Lengthwise strips 104 may include both wider lengthwise strips 104*a* and narrower lengthwise strips 104*b*. Furthermore, fluent material confinement system 100 may include a plurality of deployment indicators 108 configured to assist the deployment of the fluent material confinement system in low visibility conditions. The depicted fluent material confinement system 100 includes two wider lengthwise strips 104*a*, each positioned in a second-to-outermost position. However, either more or fewer wider lengthwise strips 104*a* may also be used.

Figure 12:
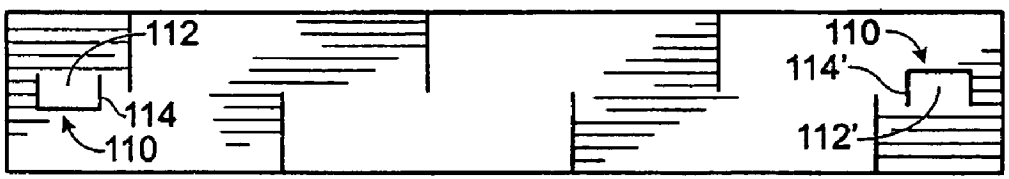
FIG. 12 is a side elevational view of a narrower lengthwise strip of the embodiment of FIG. 11.

As mentioned above, fluent material confinement system 100 also includes connecting structures 110 disposed adjacent each end. Each connecting structure 110 includes a tongue 112 formed from a slot or aperture 114 spaced from the edges of the ends of wider lengthwise strips 104*a* and narrower lengthwise strip 104*b*. An exemplary narrower lengthwise strip 314*b* is shown in more detail in FIG. 12. Tongues 112 are oriented generally perpendicular to the long dimension of strip 314*b*. Furthermore, tongue 112 on one end of narrower lengthwise strip 314*b* is oriented approximately one hundred and eighty degrees from the tongue 112' and slot 114' on the other end of the narrower lengthwise strip. Thus, when two fluent material confinement systems 100 are arranged in a side-by-side manner, tongue 112 on one fluent material confinement system is oriented for insertion into adjacent slot 114 on the adjacent fluent material confinement system. Likewise, tongue 112' is oriented for insertion into adjacent slot 114' on the adjacent fluent material confinement system. In this matter, tongue 112 on one fluent material confinement system can be inserted behind tongue 112' and through aperture 114' on the other fluent material confinement system to join the two systems together. Tongues 112 and 112' may be positioned closer to the end of lengthwise strips 104 than to the closest widthwise strip to facilitate articulation of a fluent material confinement system relative to an adjacent, connected fluent material confinement system.

While the depicted embodiment includes a connecting structure 110 at each end of each lengthwise strip 104, it will be appreciated that any other suitable arrangement of connecting structures may be used. For example, where a fluent material confinement system is configured to be located at the end of a barrier structure, each lengthwise strip 104 may have a single connecting structure. Additionally, each tongue 112, 112' in the depicted embodiment has a generally "U"-shaped configuration, it will be appreciated that the aperture may have any other suitable configuration, such as a simple straight slot or a "V"-shaped configuration.

Figure 13:
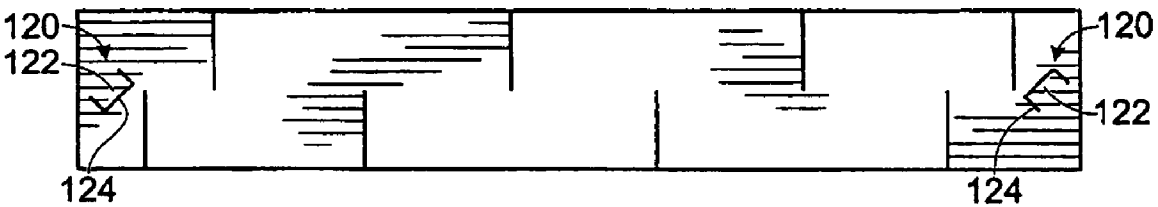
FIG. 13 is a side elevational view of an alternate embodiment of a narrower lengthwise strip.

FIG. 13 shows, generally at 120, another alternative connecting structure suitable for use in connecting adjacent fluent material confinement systems together. Connecting structure 120 includes a tongue 122 formed by a slot 124. Tongue 122 is oriented generally diagonally to the long dimension of the strip. The depicted tongue 122 is oriented approximately 45 degrees from the long dimension of the strip, but it will be appreciated that the tongue may have any other suitable generally diagonal orientation. A complementary tongue 122' and slot 124' is disposed at the other end of the strip. Complementary tongue 122' and slot 124' are oriented approximately one hundred and eighty degrees from tongue 122 and slot 124. This orientation may facilitate the insertion of tongue 122 into complementary slot 124' on an adjacent fluent material confinement system. However, tongue 122 and complementary tongue 122' may have any other suitable orientation relative to one another.

Figure 14:
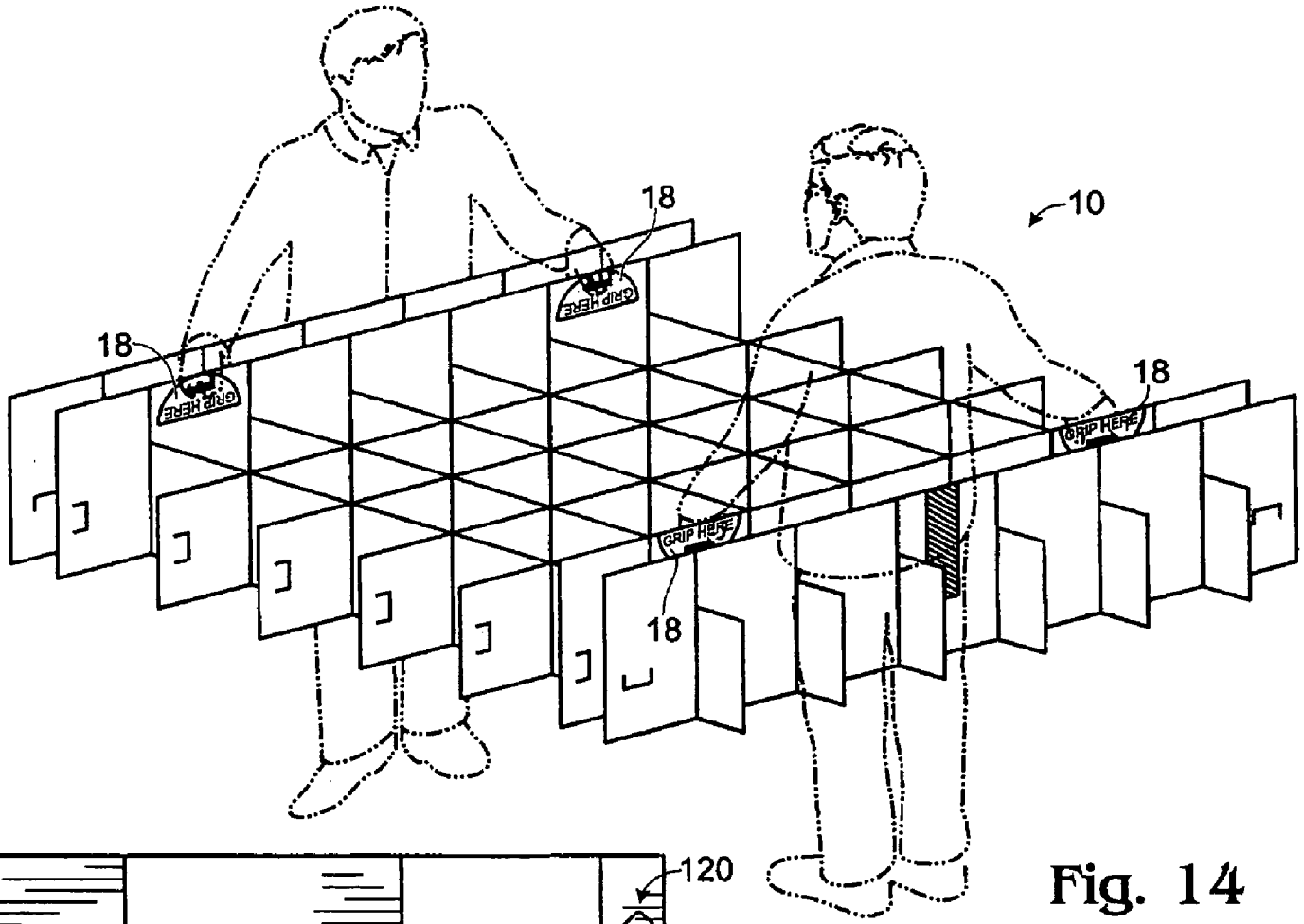
FIG. 14 is a view depicting the deployment of the embodiment of FIG. 1.

A fluent material confinement system may be quickly and easily deployed by two users, as shown in FIG. 14 in the context of fluent confinement system 100. The users may stand face to face on opposite sides of the collapsed fluent material confinement system 100, grip the fluent material confinement system where indicated, and simply pull in the direction indicated by deployment indicators 108. This causes fluent material confinement system 100 to quickly and easily convert to the open configuration. Then, fluent material confinement system 100 may be placed in a desired location, and another fluent material confinement system opened for placement on top of or beside the first one to form an extended structure. The structures may then simply be filled with sand or other fluent material by a third person utilizing a suitable piece of equipment, such as a front loader, to complete the barrier structure. A completed barrier structure is shown generally at 200 in FIG. 15. When correctly assembled, vertical alignment indicators 19 form lines down barrier structure 200 at regular intervals. Furthermore, connectors 21 and 23 of wider lengthwise strips 14*a*" are covered by the overlapping portion of the wider lengthwise strips of the next highest layer, helping to further reinforce the barrier. It has been found that a barrier structure such as that shown at 200 may be constructed with fluent material confinement system 10 as much as one hundred times faster (in total man-hours) than a sandbag barrier of similar proportions. Furthermore, it has been found that a barrier may be constructed five or more times faster with fluent material confinement system 10 than with prior fluent material confinement systems having slot-type connectors and all strips of equal width.

When a temporary barrier structure is no longer needed, the temporary barrier structure may be disassembled by simply pulling the fluent material confinement systems off of one another, allowing the fluent material to fall out of the cells, and converting the fluent material confinement systems to a collapsed configuration for storage.

In some circumstances, a barrier structure of suitable strength may be constructed simply by filling an extended structure made of a plurality of fluent material confinement systems with a single granular material, such as sand or local soils. However, in other circumstances, further reinforcement may be needed. In these circumstances, a different material may be added to the border cells to reinforce the outer portion of the extended structure. Examples of materials that may be added to the outer border cells to reinforce the extended structure include concrete or cement. The concrete or cement may have any suitable proportion of components. A cement mixture of approximately 20:1 has been proven to be particularly advantageous in reinforcing the border cells, as a cement of this mixture has good hardness properties, yet can be broken down for removal without undue effort.

A barrier with cement or concrete-filled outer border cells may be constructed in any suitable manner. One example of a suitable method of construction is as follows. First, a plurality of fluent material confinement systems are stacked to a desired height and arranged to a desired length. As described above, the bottommost fluent material confinement system is positioned right side up, and other grid systems are positioned upside-down on top of the bottommost grid system.

Next, the interior cells are covered with a suitable structure to prevent cement from entering the interior cells during the pouring process. The border cells are left exposed. Examples of suitable structures for covering interior cells include sheets of plywood or lightweight metal. Next, a cement mixture is poured into the border cells. The covering structures are then removed, and the fluent material is poured into interior cells, typically using a front-loader or similar piece of heavy equipment. This method allows a solid barrier structure of a significant height and length to be rapidly constructed with the use of a small number of workers. If extra strength is desired, a second fluent material confinement system barrier may be build directly behind and against the first barrier to double the thickness of the protective barrier.

Figure 15:
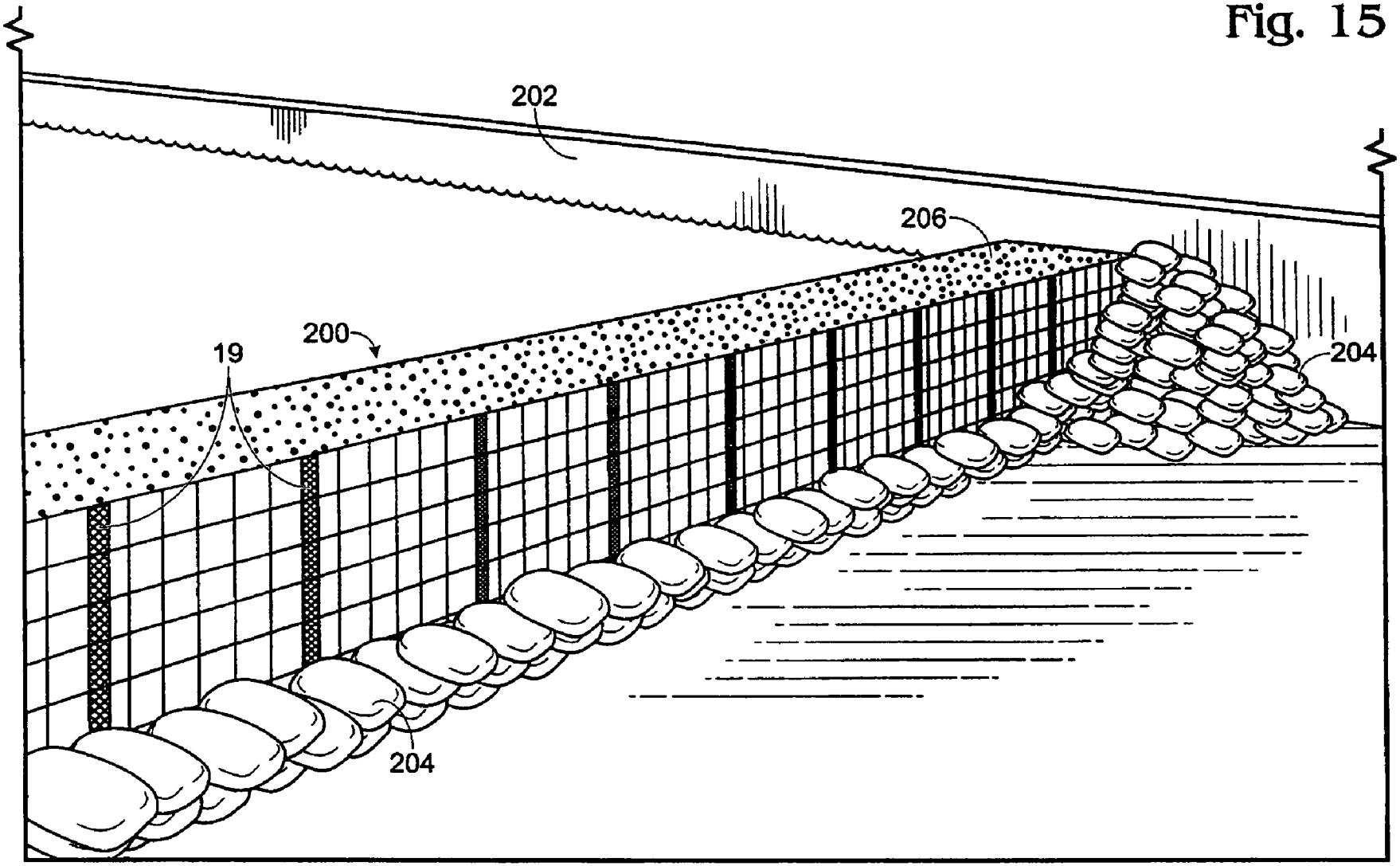
FIG. 15 is a perspective view of a plurality of fluent material confinement systems stacked, joined end-to-end, and filled with a granular fluent material to form a flood-retaining wall.

FIG. 15 also illustrates the use of a temporary protective barrier in an environment where the barrier may need to be built against another fixed object 202, such as a wall of a building or a bridge piling. In this case, the region in which barrier structure 200 meets the fixed object 202 may need to be sealed or reinforced with other materials to prevent water from seeping around the edges of, or underneath the bottom of, the temporary barrier. One suitable method of reinforcing these edge regions is to surround the edge regions with material-filled bags 204. Bags 204 may contain sand, or any other suitable material, such as a cement mixture. Moreover, a cement mixture, typically a 20:1 mixture, may be poured into the space between the fixed object and the barrier to fill any space left between the barrier. Finally, a line of bags 204 may also be placed along the bottom of barrier structure 200 to prevent water from seeping underneath the bottom of barrier structure 200. The fluent material 206 contained within barrier structure 200 provides the structural integrity for the wall, while sandbags 204 seal the seams between the barrier structure and other surrounding structures.

Figure 16:
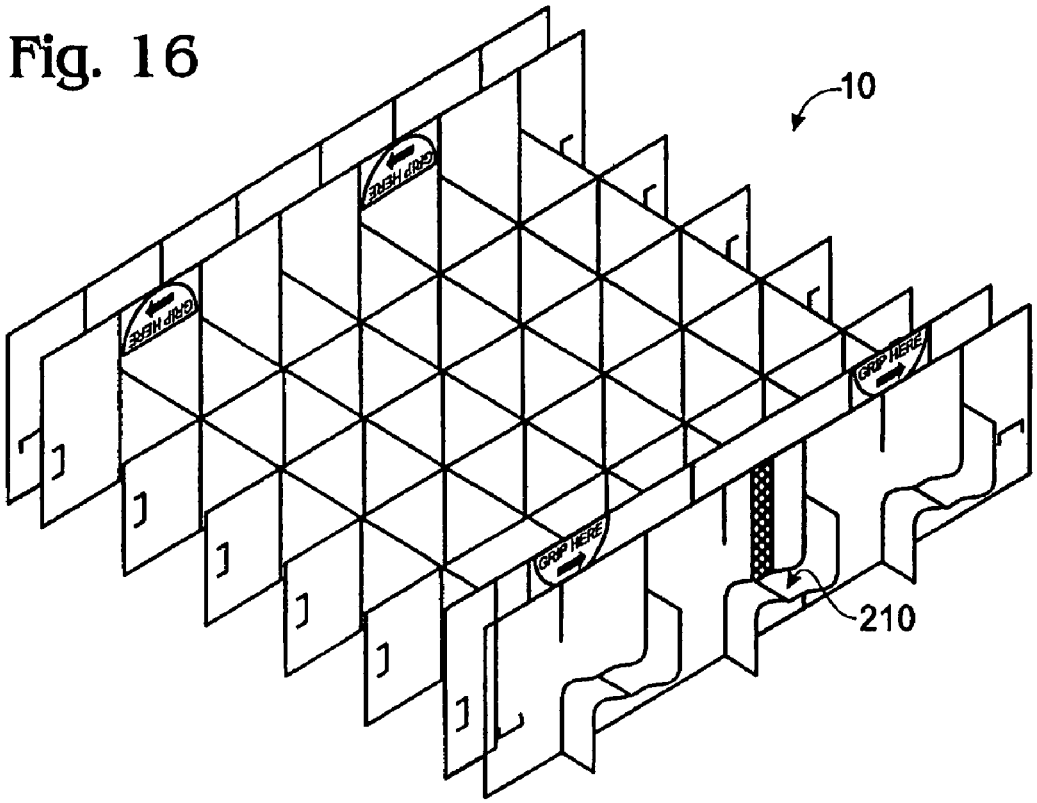
FIG. 16 is an isometric view of the embodiment of FIG. 1, wherein the ends of adjacent widthwise strips are connected to reinforce the outermost cells.

To provide further support to barrier cells 12*b*, the lower ends of some widthwise strips may be coupled with the upper ends of other widthwise strips, as shown in FIG. 16. This arrangement creates a brace 210 that extends across every other barrier cell 12*b*, and thus stiffens the walls of the supported barrier cells. The ends of widthwise strips may be connected together by a suitable fastener, including but not limited to, wire ties, ring connectors, cotter pins, bolts, etc., adhesive tape, glue or other adhesives, or may simply be held in place via friction and pressure the adjacent widthwise strip ends exert on each other.

The connector configurations shown in the embodiments depicted in FIGS. 1 and 11 are suitable for connecting a plurality of fluent material confinement systems together to form a straight barrier structure. A barrier structure that extends in a non-linear fashion may be formed by simply forming a barrier structure that butts against a prior barrier structure at a desired angle. However, the location at which the two barrier structures meet may be a point of weakness. To provide for a stronger multi-directional structure, a corner fluent material confinement system that has connectors provided on the widthwise struts may be used to introduce a directional change into a barrier structure. Such a corner fluent material confinement system may facilitate the construction of temporary barrier structures such as revetments, dams or levees around curved points of land, etc.

Figure 17:
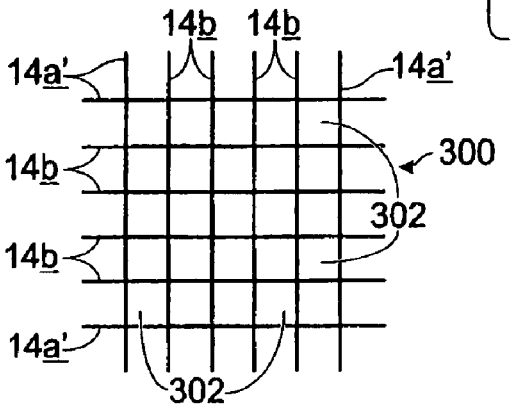
FIG. 17 is a plan view of a corner fluent material confinement system according to another embodiment.

FIG. 17 shows, generally at 300, a schematic plan view of a suitable corner fluent material confinement system. Corner fluent material confinement system 300 includes a plurality of narrow lengthwise strips 14*b* running in both the lengthwise and widthwise direction. The plurality of narrow lengthwise strips 14*b* are enclosed on each side by a wider lengthwise strip 14*a*' (or 14*a*"). Thus, corner fluent material confinement system 300 includes connecting structures on each end of each of its lengthwise and widthwise strips, and may accept the attachment of any suitable fluent material confinement system on any of its sides. The use of wider strips around the perimeter of corner fluent material confinement system 300 helps to reinforce the barrier cells 302 of the corner fluent material confinement system, and to prevent sand from escaping the barrier cells.

While the depicted corner fluent material confinement system includes wider strips only as the outermost strips, it will be appreciated that a corner fluent material confinement system may have either more or fewer wider strips, and may have either all wider strips, or all narrower strips. Furthermore, while the depicted corner fluent material confinement system is formed from a plurality of strips 14*a*' and 14*b* it will be appreciated that a corner fluent material confinement system may include any other suitable combination of strips disclosed herein or in U.S. patent application Ser. No. 10/086,772, incorporated by reference herein.

Figure 18:
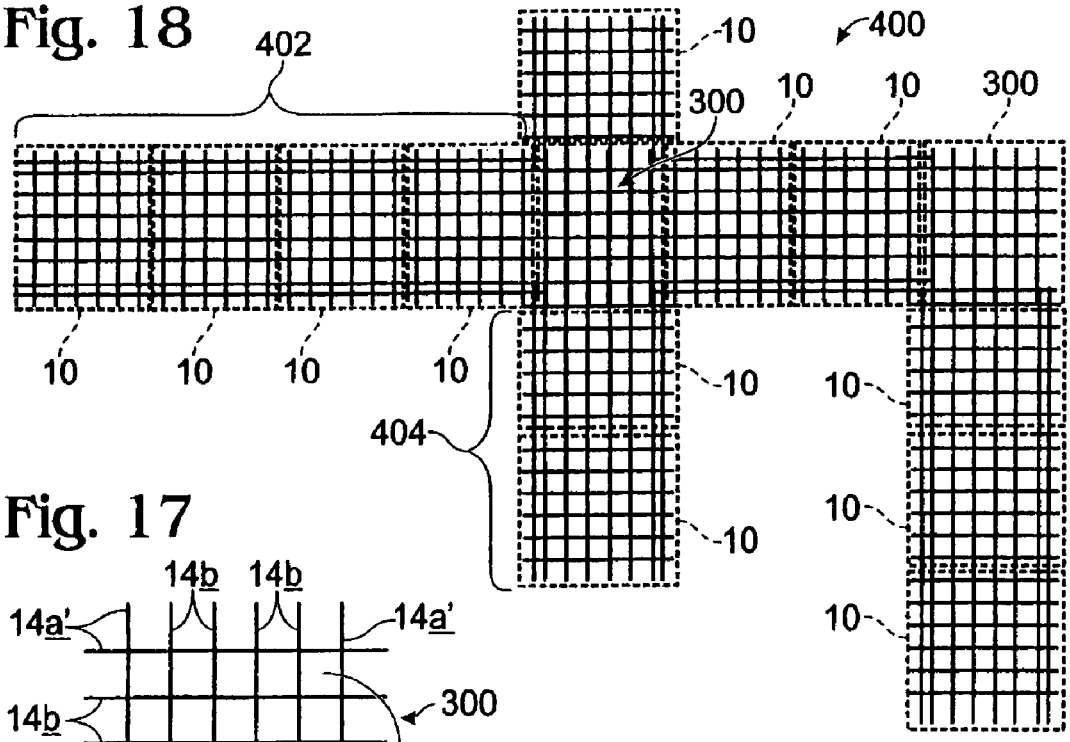
FIG. 18 is a plan view of a plurality of fluent material confinement systems arranged in a first exemplary extended structure, showing an exemplary use of the embodiment of FIG. 17.

FIG. 18 shows a schematic plan view of a multi-directional extended barrier structure, indicated generally at 400, formed from a plurality of fluent material confinement systems. The depicted barrier structure includes a plurality of fluent material confinement systems 10, and two corner fluent material confinement systems 300. The corner fluent material confinement systems 300 introduce directional changes in the barrier. For example, barrier segment 402 and barrier segment 404 meet at roughly a right angle at one of corner pieces 300. The angle at which barrier segments meet may be varied somewhat by partially collapsing corner piece 300 toward the collapsed configuration shown in FIG. 7. Furthermore, where the fluent material confinement systems are constructed of a flexible material, adjacent walls may be bent slightly out of a right-angle configuration. To facilitate the construction of a multi-directional extended structure, corner fluent material confinement systems 300 may have different deployment indicators (not shown) than fluent material confinement systems 10.

As described above, the use of wider lengthwise strips 14*a* as the outermost two strips helps prevent sand from leaking out from between the outermost strips of adjacent grid layers, and thus helps to preserve the integrity of the grid structure. Furthermore, a blocking strip may be used to seal the ends of a barrier structure to keep sand from leaking out from between adjacent grid layers at the ends of the barrier structure.

Figure 19A:
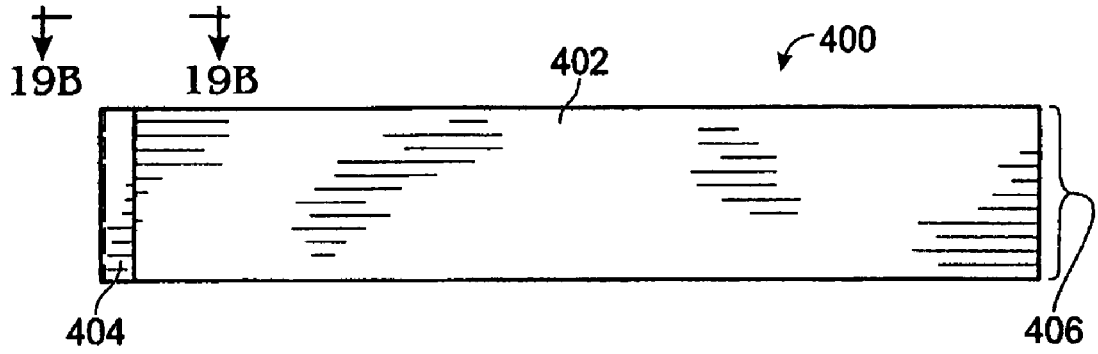
FIG. 19*a* is a side elevational view of a blocking strip configured to prevent sand from flowing out of the ends of a structure constructed of a plurality of fluent material confinement systems.
Figure 19B:
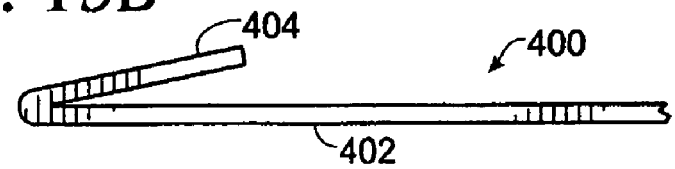
FIG. 19*b* is a top view of an end portion of the blocking strip of FIG. 19*a*.
Figure 21:
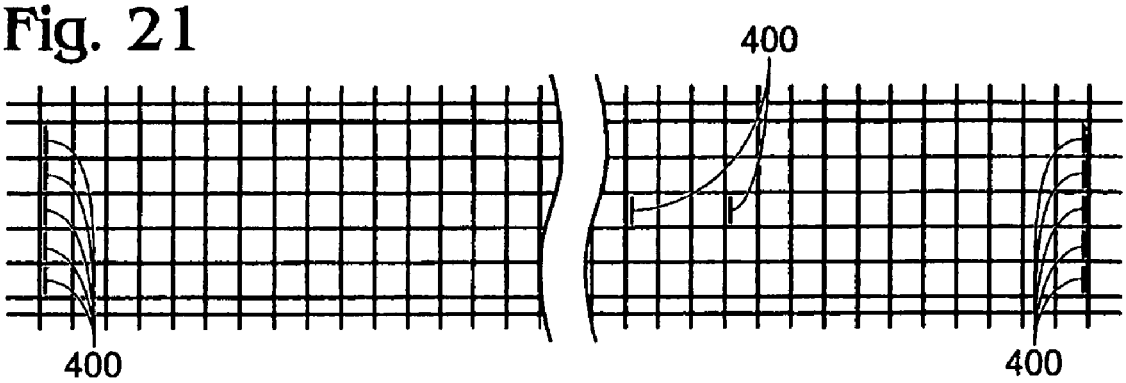
FIG. 21 is a plan view of a plurality of fluent material confinement systems arranged in a second exemplary extended structure, which shows an exemplary use of the embodiments of FIGS. 19 and 20.

FIGS. 19*a* and 19*b* show, generally at 400, a first embodiment of a blocking strip suitable for sealing the ends of a barrier structure. Blocking strip 400 includes an elongate face portion 402, and a hooked end portion 404. Elongate face portion 402 has a width 406 approximately equal to the width of interior cells 12*a*. After assembling a barrier structure of a desired height, but before filling the barrier structure with sand, blocking strip 400 may be inserted vertically into each cell column at each end of the barrier structure, such that the blocking strip hangs from the outermost widthwise strip 16 of the uppermost fluent material confinement system at each end of the structure by hooked end portion 404. This is shown schematically in FIG. 21. In this manner, elongate face portion 402 of each blocking strip 400 helps to block any gaps between vertically adjacent fluent material confinement systems, and thus help to prevent sand from leaking out of the ends of the barrier structure. While the depicted embodiment includes a hooked end portion 404 at only one end of blocking strip 400, it will be appreciated that a hooked end portion 404 could be provided at each end of the strip. This may allow blocking strip 400 to be inserted into the barrier structure with either end first, and thus may contribute to the ease of constructing a barrier structure in conditions having poor visibility.

Figure 20:
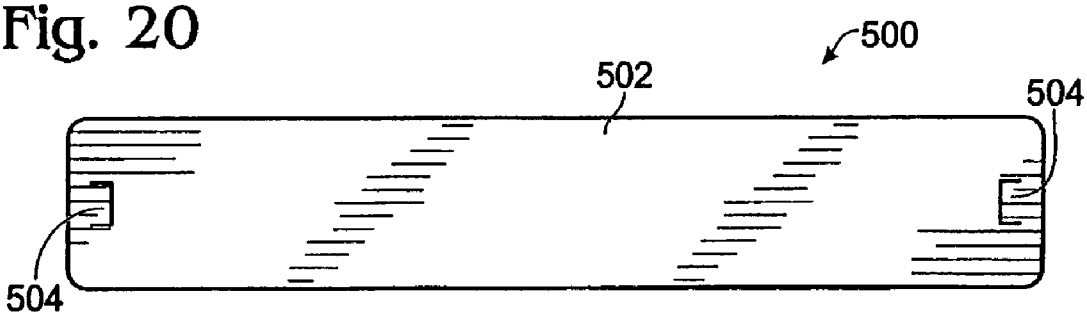
FIG. 20 is a side elevational view of an alternate embodiment of a blocking strip.

FIG. 20 shows an alternate embodiment of a blocking strip, generally at 500. Blocking strip 500 includes an elongate face portion 502, and a tongue connector 504 formed in at least one end of the strip. Like blocking strip 400, blocking strip 500 is configured to be inserted vertically into an end cell of a fully constructed barrier structure before the barrier structure is filled with sand. In this manner, face portion 502 of blocking strip 500 blocks gaps between vertically adjacent fluent material confinement systems to help prevent sand from leaking out of the ends of the barrier structure.

Tongue connector 504 is configured to connect over the outermost widthwise strip 16 of the uppermost fluent material confinement system such that blocking strip 504 hangs downwardly into a column of cells, thus performing essentially the same function as hooked end portion 404 of the embodiment of FIGS. 19*a* and 19*b*. Tongue connector 504 may be provided at only one end of blocking strip, or at each end, as shown in FIG. 20. Providing a tongue connector 504 at each end of blocking strip may allow blocking strip 500 to be inserted into the barrier structure with either end first, and thus may contribute to the ease of constructing a barrier structure in conditions having poor visibility. Furthermore, tongue connector 504 may be hooked over a strip of an uppermost fluent material confinement system in a barrier structure no matter which face of blocking strip 500 is oriented toward the outside of the barrier structure. Thus, the use of a tongue connector 504 at each end of blocking strip 500 may allow the blocking strip to be inserted into a barrier structure with either end first, and facing either direction.

It will be appreciated that blocking strips 400 and 500 may also be placed in cells other than cells at the ends of a barrier structure. For example, one or more blocking strips 400 and 500 may be placed in inner cells 12*a* to hold the cells open, and to hold a plurality of vertically stacked fluent material confinement systems in a correct alignment, upon completion of an extended structure but before filling the extended structure with sand to form a barrier structure. This is illustrated at 400' in FIG. 21.

Figure 22:
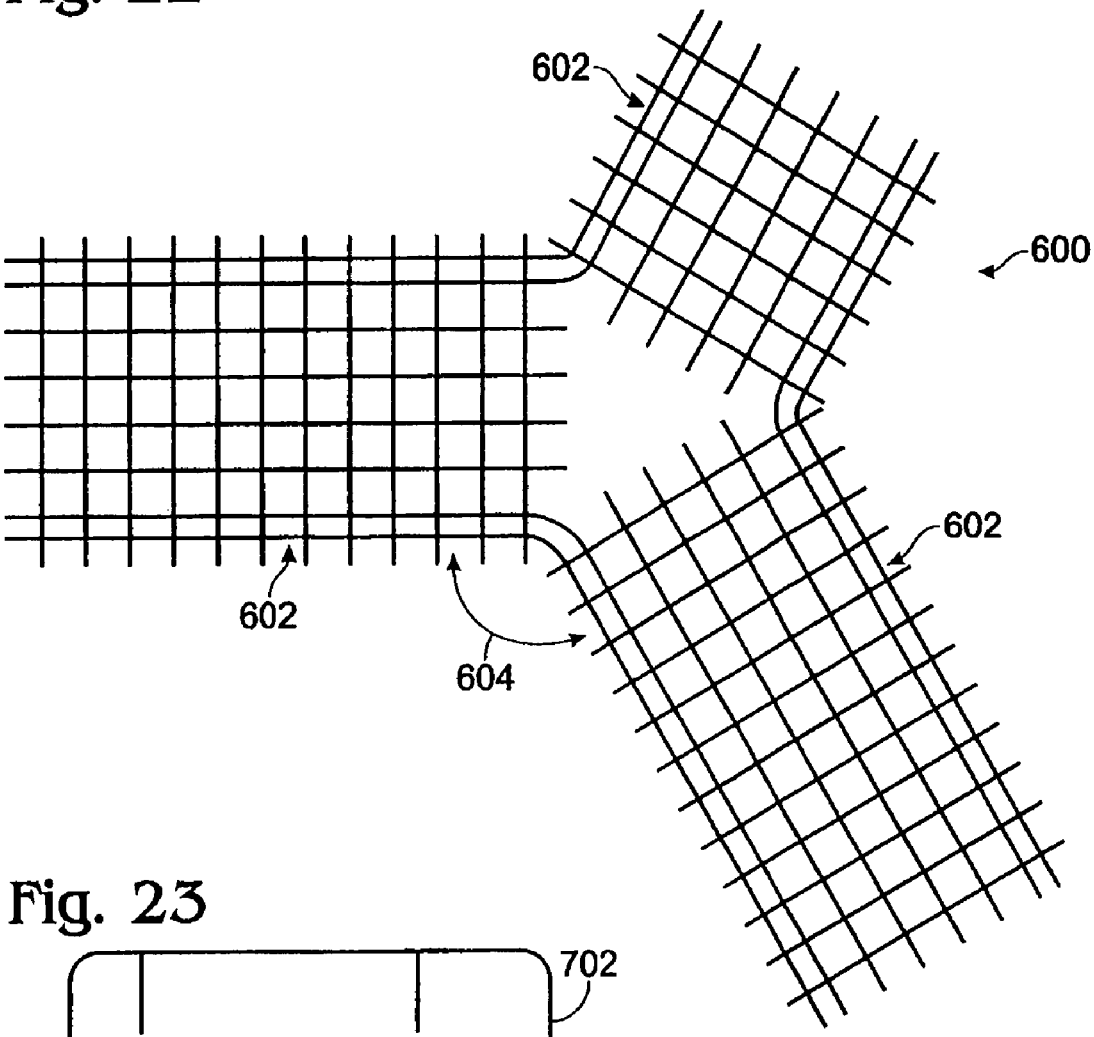
FIG. 22 is a plan view of a plurality of fluent material confinement systems arranged in a third exemplary extended structure.

FIG. 22 shows, generally at 600, another example of an extended structure that may be constructed with a plurality of fluent material confinement systems 10. Barrier structure 600 includes three separate linear wall segments 602 that meet each other at an outer angle 604 of one hundred twenty degrees. The walls are connected together by outermost wider lengthwise strips 14*a*". Where the strips are made of a flexible material, outermost strips 14*a*" curve to form smooth corners with no significant gaps through which sand may leak. While each linear wall segment 602 of FIG. 22 meets the other linear wall segments at an outer angle of approximately one hundred twenty degrees, it will be appreciated that the flexible nature of outermost lengthwise strips 14*a*" allows the linear wall segments to meet at a wide range of possible outer angles, including angles of approximately 90 degrees, thereby achieving a right angle connection without the use of corner fluent material confinement system 300.

Figure 23:
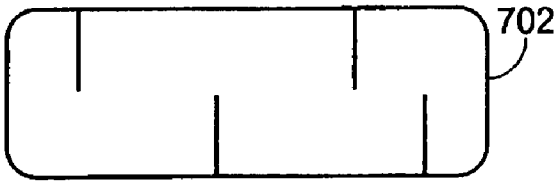
FIG. 23 is a view of an embodiment of a widthwise strip for constructing a reduced size fluent material confinement system.
Figure 24:
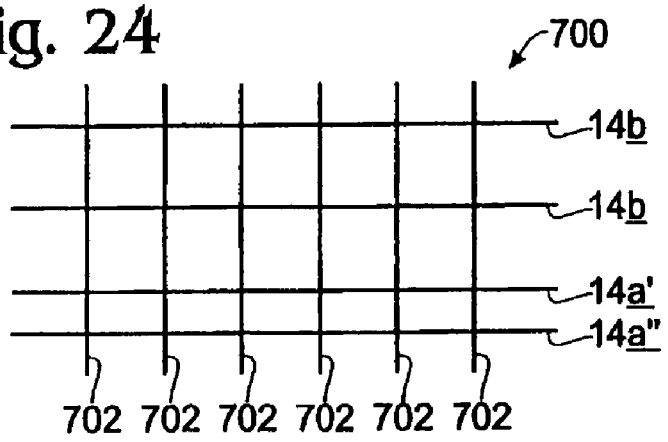
FIG. 24 is a plan view of an embodiment of a reduced size fluent material confinement system.

As mentioned above, a fluent material confinement system may have any suitable shape and relative dimensions. FIG. 23 shows, at 702, an embodiment of a shortened widthwise strip suitable for constructing a reduced-size fluent material confinement system, and an exemplary embodiment of a reduced-size fluent material confinement system is indicated in FIG. 24 generally at 700. Reduced-size fluent material confinement system 700 is formed from one wider lengthwise strip 14*a*', one wider lengthwise strip 14*a*", two narrower lengthwise strips 14*b*, and six widthwise strips 702. The depicted widthwise strips 702 are approximately one-half the length of widthwise strips 16 of fluent material confinement system 10, making the overall footprint of fluent material confinement system 700 about one-half the size of the overall footprint of fluent material confinement system 10. However, it will be appreciated that widthwise strips 702 may have any other suitable length.

Figure 25A:
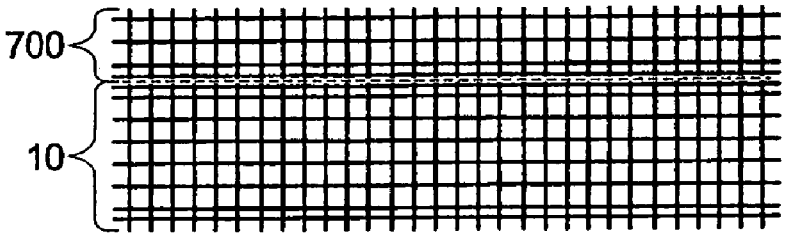
FIG. 25*a* is a plan view of an embodiment of an extended structure constructed from a plurality of fluent material confinement systems and reduced size fluent material confinement systems.
Figure 25B:
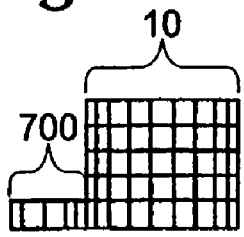
FIG. 25*b* is a side view of the embodiment of FIG. 25*a*.
Figure 26:
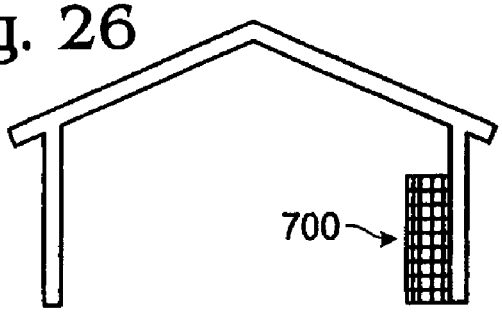
FIG. 26 is a side schematic view of an extended structure constructed from a plurality of reduced size fluent material confinement systems used to reinforce a wall of a building.

Reduced-size fluent material confinement system 700 may be used for many different purposes. For example, reduced-size fluent material confinement system 700 may be used in the place of or in addition to sandbags to reinforce the foot of an extended structure constructed of a plurality of fluent material confinement systems 10, as shown in FIGS. 25*a* and 25*b* or may be used to reinforce the interior walls of structures such as buildings, houses, etc., as shown in FIG. 26, where space is too limited to use fluent material confinement systems 10. It will be appreciated that these uses are merely exemplary, and that reduced-size fluent material confinement system 700 may be used for any other suitable purpose.

Figure 27:
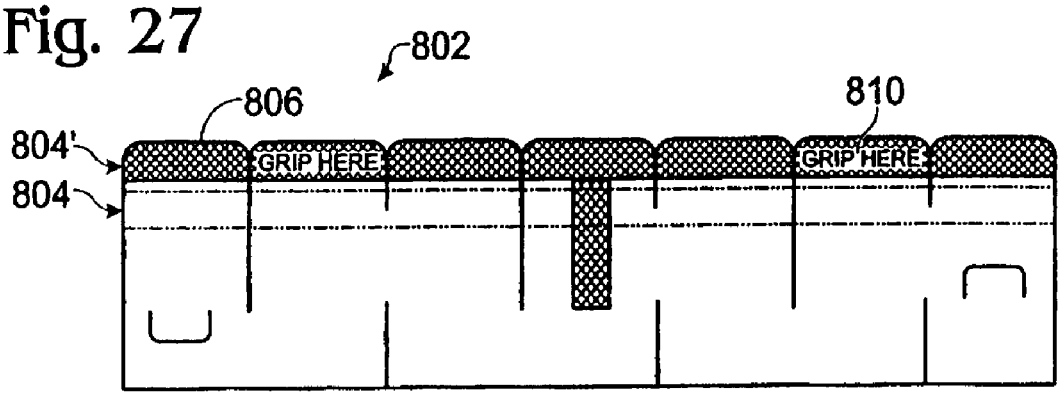
FIG. 27 is a side elevational view of an embodiment of a wider widthwise strip having a stacking error indicator.

FIG. 27 shows another alternative embodiment of a wider lengthwise strip, generally at 802. Wider lengthwise strip 802 includes a stacking error indicator 804 extending along the length of the strip. Stacking error indicator 804 is positioned adjacent to, but spaced from, an edge 806 of wider lengthwise strip 802. Alternatively, the stacking error indicator may be positioned directly adjacent to edge 806 of wider lengthwise strip 802, as indicated at 804', or in any other suitable location. Where details of the structure and function of stacking error indicator 804 are discussed herein, it will be appreciated that the discussion also may apply to stacking error indicator 804'.

Stacking error indicator 804 aids in the avoidance of stacking errors during the construction of extended structures. Extended structures built with fluent material confinement systems 10 (or 700) may have a greater strength when the wider lengthwise strips of each fluent material confinement system are nested against the inside face of the corresponding strip on the next-lowest fluent material confinement system, as opposed to the outside face. The term "inside face" as used herein indicates the face of each wider widthwise strip that faces toward the center of the grid structure. This construction may help to prevent the wider lengthwise strips of the structure from dog-earing when the structure is being filled with sand, and also may help to prevent sand from leaking out of the outermost protective cells when the extended structure is stressed, for example, by wave impacts.

However, when constructing an extended barrier structure under stressful and/or low-visibility conditions, errors in the proper stacking or nesting of stacked fluent material confinement systems may occur. Specifically, segments of the wider lengthwise strips of the fluent material confinement systems may be located to the outside of the corresponding wider lengthwise strips of the next-lowest fluent material confinement system during stacking. Moreover, due to the relatively complex geometrical appearance of the barrier structure, such stacking errors may be difficult to spot and correct, especially in low visibility conditions.

Figure 28:
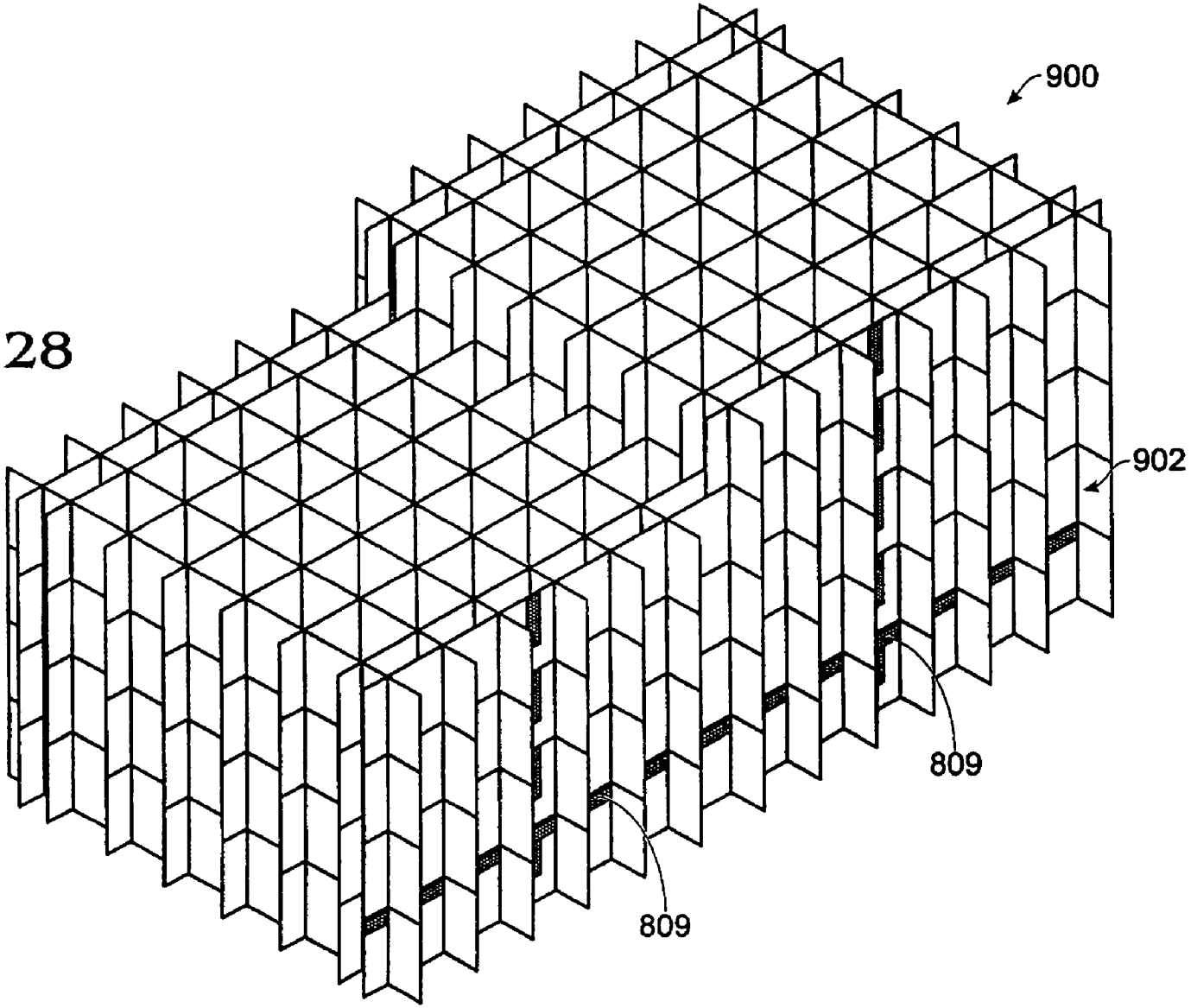
FIG. 28 is a perspective view of an extended structure formed from a plurality of fluent material confinement systems, with stacking error indicators indicating no stacking errors.

Stacking error indicator 804 acts as a simple visual reference to indicate whether a wider lengthwise strip from one fluent material confinement system in an extended structure is nested inside of, or outside of, the next-lowest fluent material confinement system. Stacking error indicator 804 may be included only on outermost wider lengthwise strip 14*a*', on next-to-outermost wider lengthwise strip 14*a*", or on both strips 14*a*' and 14*a*". Furthermore, stacking error indicator 804 may be provided on an outer face, an inner face, or both an outer and inner face of each of wider lengthwise strips 14*a*. Furthermore, a deployment indicator 810 may be used in conjunction with stacking error indicator 804. FIG. 28 illustrates an exemplary barrier structure, generally at 900, which has no stacking errors, and FIG. 29 illustrates an exemplary barrier structure, generally at 1000, which has stacking errors.

First referring to FIG. 28, the stacking error indicators 804 on each fluent material confinement system 10 on the lowest layer of the extended structure form an unbroken line 902 across the face of extended structure 900. The appearance of an unbroken line indicates that all outermost and second-to-outermost lengthwise strips from the second-lowest layer of fluent material confinement systems 10 are nested within the corresponding strips on the lowest layer of fluent material confinement systems in extended structure 900 when the second-to-lowest layer of fluent material confinement systems is stacked correctly on the lowest layer. Furthermore, no other stacking error indicators 804 are visible at any other location on the face of extended structure 900, indicating that all other wider lengthwise strips of each layer in the extended structure are nested within the interior of the next-lowest layer in the extended structure.

Figure 29:
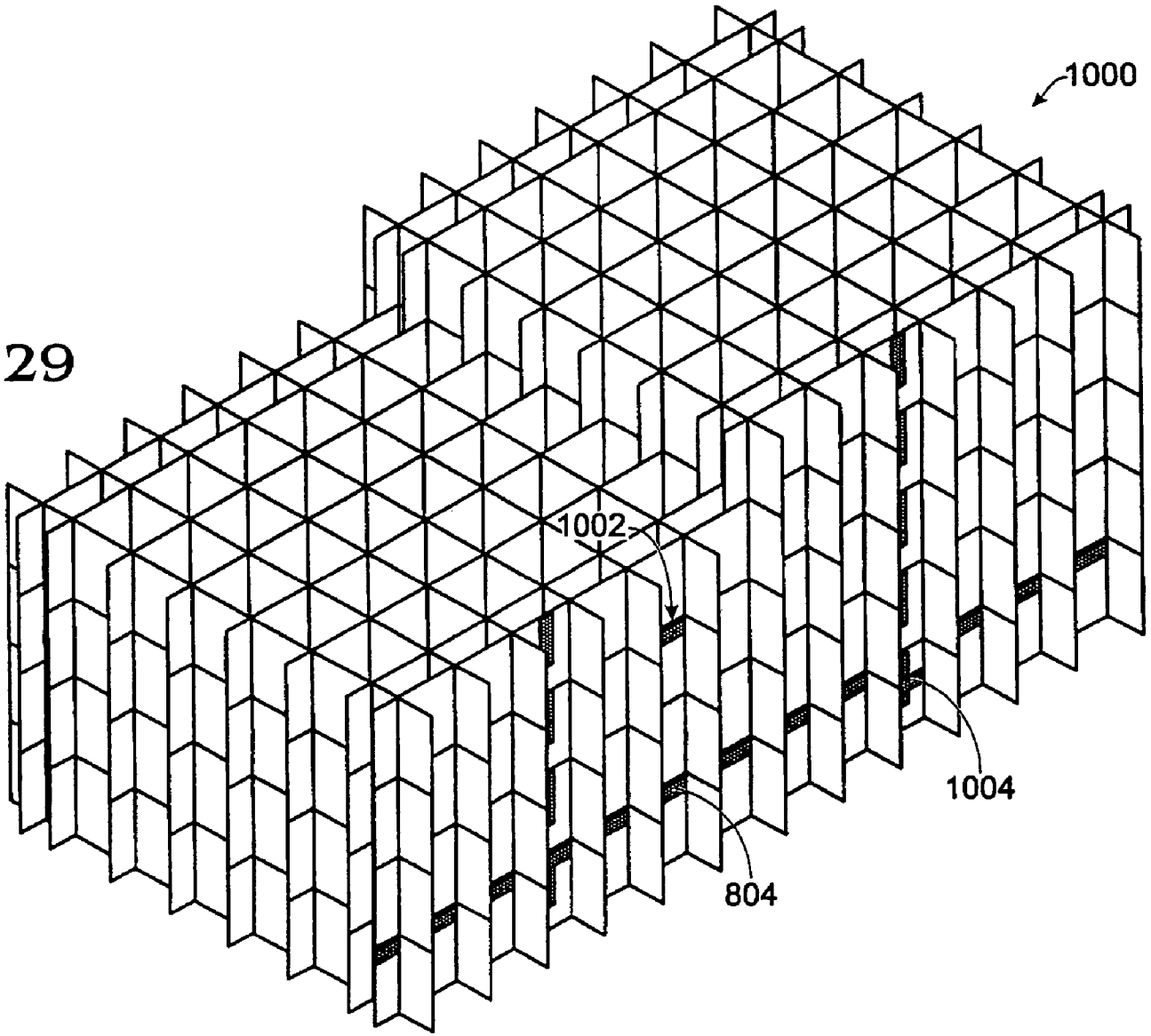
FIG. 29 is a perspective view of the extended structure of FIG. 28, with the stacking error indicators indicating stacking errors.

Next referring to FIG. 29, a stacking error 1002 can be seen about midway up the face of extended structure 1000, and another stacking error 1004 can be seen adjacent to the bottom of the structure (where the first and second grid levels meet). At stacking error 1002, a single segment (i.e. a section between slots 24) of an outermost wider lengthwise strip 14*a*" is nested to the outside of the next-lowest layer, rather than to the inside. This is indicated by the appearance of stacking error indicator 804 at the location of the stacking error. At stacking error 1004, a missing segment in the stacking error indicator 804 of the bottommost fluent material confinement system indicates that a portion of the bottommost fluent material confinement system is improperly nested inside of the next-highest system. The error appears as an offset segment of stacking error indicator 804. These error could possibly cause sand to leak out of the structure during filling and/or when under stress, and could also cause the strip in the next-lowest layer that is positioned to the inside of the next-highest layer to dog-ear during filling, thus preventing sand from completely filling the structure. Without stacking error indicator 804, such a stacking error could be quite difficult to detect. However, with stacking error indicator 804, the error is easily visible with a cursory visual inspection to check for missing (in lowest layer) or visible (in other layers) segments of stacking error indicators 804, and can be quickly and easily fixed before the next layer of extended structure 1000 is constructed, or even at the moment the stacking error is made. The wider lengthwise strips may be opaque so that no stacking error indicators 804 nested to the inside of a next-lowest layer are visible through the wider widthwise strips, thereby helping to prevent users from overlooking stacking errors.

Stacking errors can also be detected on the inner wider widthwise strips using stacking error indicators 804, especially where the narrower lengthwise strips of the stacking error indicator are at least partially transparent. For example, where a fluent material confinement system has an inner wider widthwise strip with a section improperly nested relative to a next-lowest fluent material confinement system, stacking error indicator 804 will be visible to a user standing on the opposite side of the structure as the stacking error through the transparent narrower lengthwise strips. This allows a team of two people to assemble a barrier structure working across from one another as depicted in FIG. 14 to quickly locate and correct stacking errors on both the outside and inside wider lengthwise strips while assembling a barrier structure and before fluent material is added to the barrier structure.

Figure 30:
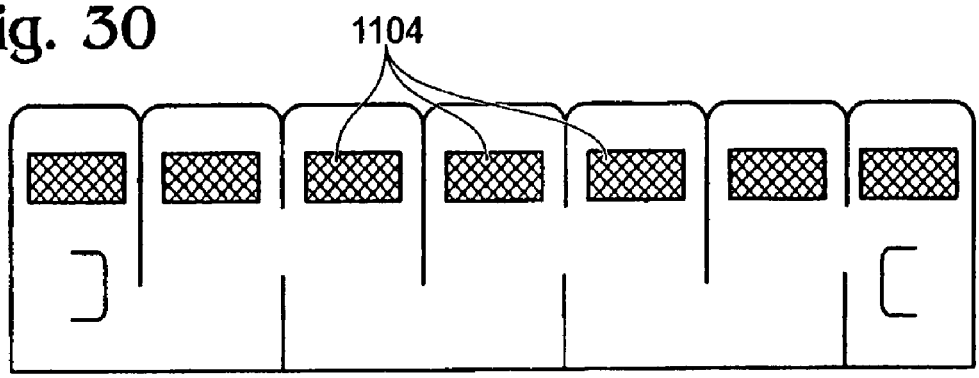
FIG. 30 is a side elevational view of another embodiment of a wider widthwise strip having a stacking error indicator.

As mentioned above, stacking error indicator 804 may have any suitable appearance for indicating the existence of a stacking error. For example, stacking error indicator 804 may have a solid or patterned appearance, such an arrow pattern, a cross-hatched pattern, etc. Alternatively, stacking error indicator 804 may have a solid appearance, as shown in FIGS. 24-26. Furthermore, stacking error indicator 804 may extend entirely across wider lengthwise strip 14*a* in an unbroken fashion, as depicted in FIG. 27, or may have the appearance of a broken line, as shown at 1104 in FIG. 30. Furthermore, wider lengthwise strip 14*a* may have an opaque appearance, including but not limited to a white or beige appearance, to have greater visual contrast with stacking error indicator 804. Furthermore, stacking error indicator 804 may take the form of a discrete mark, symbol, etc. that appears on each segment of the lengthwise strips, wherein each segment is defined by the length of a single cell. It will be appreciated that stacking error indicator 804 may serve other purposes than indicating the presence of stacking errors. For example, the line (shown at 900 in FIG. 28) formed across the bottom of a barrier structure by stacking error indicator 804 may be used as a marker to indicate how high to stack a line of sandbags in front of the wall, should additional protection be desired.

Although the present disclosure includes specific embodiments of barriers fluent material confinement systems and methods of using the systems, specific embodiments are not to be considered in a limiting sense, because numerous variations are possible. The subject matter of the present disclosure includes all novel and nonobvious combinations and subcombinations of the various fluent material confinement systems, methods of using the systems, structures that can be built with the systems, and other elements, features, functions, and/or properties disclosed herein. The description and examples contained herein are not intended to limit the scope of the invention, but are included for illustration purposes only. It is to be understood that other embodiments of the invention can be developed and fall within the spirit and scope of the invention and claims.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

What is claimed is:

1. A fluent material confinement system configured to receive a granular fluent material and to be stacked on a next-lowest fluent material confinement system to form a temporary barrier structure, the fluent material confinement system comprising:

a plurality of strips, the plurality of strips including a plurality of lengthwise strips and a plurality of widthwise strips coupled with each other to define a plurality of open cells, wherein the plurality of lengthwise strips includes an outermost lengthwise strip, a second outermost lengthwise strip, and a plurality of inner lengthwise strips, wherein the outermost lengthwise strip and the second outermost lengthwise strip have a greater width than a remainder of the lengthwise strips and widthwise strips, wherein the outermost wider strip and second outermost wider strip are configured to extend into cells of the next-lowest fluent material confinement system when the fluent material confinement system is stacked on the next-lowest fluent material confinement system, and wherein the remainder of the lengthwise strips and widthwise strips are configured not to extend into the cells of the next-lowest fluid material confinement system when stacked; and a stacking error indicator located on the outermost wider lengthwise strip to indicate to a user a location of an error in stacking of the fluent material confinement system on the next-lowest fluent material confinement system.

2. The fluent material confinement system of claim 1, wherein the outermost wider lengthwise strip includes a length, and wherein the stacking error indicator extends substantially the length of the outermost wider lengthwise strip.

3. The fluent material confinement system of claim 1, wherein the outermost wider lengthwise strip includes a length, and where the stacking error indicator is segmented along the length of outermost the wider lengthwise strip.

4. The fluent material confinement system of claim 1, wherein the stacking error indicator extends only a portion of the width of the outermost wider lengthwise strip.

5. The fluent material confinement system of claim 1, wherein the stacking error indicator has a different color than other portions of the outermost wider lengthwise strip.

6. The fluent material confinement system of claim 1, wherein the outermost wider lengthwise strip is opaque.

7. The fluent material confinement system of claim 1, wherein the stacking error indicator extends from an upper edge of the outermost wider lengthwise strip.

8. The fluent material confinement system of claim 1, wherein the stacking error indicator is spaced from an upper edge of the outermost wider lengthwise strip.

9. The fluent material confinement system of claim 1, wherein the outermost wider widthwise strip is configured to nest within a row of cells in the next-lowest fluent material confinement system, and wherein the stacking error indicator is more visible where a segment of the outermost wider widthwise strip is positioned outside of a cell of the row of cells and is less visible where a segment of the outermost wider widthwise strip is positioned within a cell of the row of cells.

10. The fluent material confinement system of claim 1, wherein the next-lowest fluent material confinement system is a lowermost fluent material confinement system in a barrier structure, and wherein the lowermost fluent material confinement system includes a lowermost widthwise strip having a lowermost stacking error indicator visible in positions where a next-highest fluent material confinement system is properly stacked on the lowermost fluent material confinement system.

11. The fluent material confinement system of claim 1, wherein the outermost wider lengthwise strip includes a first lengthwise edge, a second lengthwise edge, and a plurality of outer corners, wherein the outer corners adjacent the first lengthwise edge have a curved configuration, and wherein the outer corners adjacent the second lengthwise edge have an angled configuration.

12. The fluent material confinement system of claim 11, further comprising a first plurality of slots formed in the first lengthwise edge and a second plurality of slots formed in the second lengthwise edge, wherein the first plurality of slots include rounded corners wherein the first plurality of slots meet the first lengthwise edge, and wherein the second plurality of slots include corners with approximately right angles where the second plurality of slots meet the second lengthwise edge.

13. A fluent material confinement system configured to receive a granular fluent solid to form a temporary barrier structure, the fluent material confinement system comprising:

a plurality of strips including a plurality of lengthwise strips and a plurality of widthwise strips coupled with each other to define a plurality of open cells, wherein the plurality of lengthwise strips includes an outermost lengthwise strip, a second outermost lengthwise strip, and a plurality of inner lengthwise strips, and wherein the outermost lengthwise strip and the second outermost lengthwise strip have a greater width than a remainder of the lengthwise strips and widthwise strips.

14. The fluent material confinement system of claim 13, wherein the outermost lengthwise strip and second outermost lengthwise strip are opaque.

15. The fluent material confinement system of claim 14, wherein the inner lengthwise strips are transparent.

16. The fluent material confinement system of claim 13, wherein the fluent material confinement system is configured to be stacked on a next-lowest fluent material confinement system in a barrier structure, wherein at least one of the outermost lengthwise and the second outermost most lengthwise strip is configured to nest into the next-lowest fluent material confinement system, and wherein at least one of the outermost lengthwise strip and second outermost lengthwise strip includes a stacking error indicator configured to indicate an error nesting the fluent material confinement system into the next-lowest fluent material confinement system.

17. A fluent material confinement system configured to receive a granular fluent material and to be stacked on a next-lowest fluent material confinement system to form a temporary barrier structure, the fluent material confinement system comprising:

a plurality strips, the plurality of strips including a plurality of lengthwise strips and a plurality of widthwise strips coupled with each other to define a plurality of open cells, wherein the plurality of lengthwise strips includes at least one wider lengthwise strip configured to extend into cells of the next-lowest fluent material confinement system when the fluent material confinement system is stacked on the next-lowest fluent material confinement system and at least one narrower lengthwise strip configured not to extend into cells of the next-lowest fluent material confinement system, wherein each of the wider lengthwise strips includes generally parallel first and second lengthwise edges, and a plurality of outer corners, wherein the outer corners adjacent the first lengthwise edge have a curved configuration, and wherein the outer corners adjacent the second lengthwise edge have a substantially right-angled configuration.

18. The fluent material confinement system of claim 17, wherein the outer corners adjacent the first lengthwise edge have a rounded configuration with a radius of curvature of approximately one inch.

19. The fluent material confinement system of claim 18, further comprising a plurality of slots formed along the first lengthwise edge of the wider lengthwise strips and a plurality of slots formed along the second lengthwise edge, wherein the slots formed along the first lengthwise edge include curved corners where the slots meet the first lengthwise edge, and wherein the slots formed along the second lengthwise edge include substantially right-angled corners where the slots meet the second lengthwise edge.

20. The fluent material confinement system of claim 17, wherein the plurality of widthwise strips lack rounded corners.

* * * * *